US010885868B2

(12) United States Patent
Horibe

(10) Patent No.: US 10,885,868 B2
(45) Date of Patent: Jan. 5, 2021

(54) VOLTAGE CONTROL CIRCUIT AND DISPLAY DEVICE

(71) Applicant: SAKAI DISPLAY PRODUCTS CORPORATION, Sakai (JP)

(72) Inventor: Ryusuke Horibe, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/483,038

(22) PCT Filed: Feb. 2, 2017

(86) PCT No.: PCT/JP2017/003832
§ 371 (c)(1),
(2) Date: Aug. 1, 2019

(87) PCT Pub. No.: WO2018/142546
PCT Pub. Date: Aug. 9, 2018

(65) Prior Publication Data

US 2020/0234670 A1 Jul. 23, 2020

(51) Int. Cl.
*G09G 3/36* (2006.01)

(52) U.S. Cl.
CPC ..... *G09G 3/3696* (2013.01); *G09G 3/3688* (2013.01); *G09G 2300/0408* (2013.01); *G09G 2300/0426* (2013.01); *G09G 2310/0243* (2013.01)

(58) Field of Classification Search
CPC ..... G09G 3/3696; G09G 3/3688; G09G 2300/0426; G09G 2300/0408; G09G 2330/02; G09G 2330/028; G09G 2310/0243
See application file for complete search history.

(56) References Cited

U.S. PATENT DOCUMENTS

| | | | | |
|---|---|---|---|---|
| 7,817,172 | B2 | 10/2010 | Hong et al. | |
| 8,164,556 | B2 * | 4/2012 | Song | G09G 3/3614 345/87 |
| 8,542,226 | B2 * | 9/2013 | Li | G09G 3/3696 345/211 |
| 2006/0001640 | A1 * | 1/2006 | Lee | G09G 3/3696 345/100 |
| 2008/0001887 | A1 | 1/2008 | Hong et al. | |

FOREIGN PATENT DOCUMENTS

| | | | | |
|---|---|---|---|---|
| JP | H08-110508 | A | 4/1996 | |
| JP | 2008-009364 | A | 1/2008 | |
| WO | WO-2015100844 | A1 * | 7/2015 | G06F 3/0418 |

* cited by examiner

*Primary Examiner* — Darlene M Ritchie
(74) *Attorney, Agent, or Firm* — ScienBiziP, P.C.

(57) ABSTRACT

A voltage control circuit having three or more power supplies and a selector switch that selects one of the three or more power supplies and connects the selected power supply to the gate signal line of a liquid crystal panel. In the voltage control circuit, the selector switch sequentially switches the connection of the one of the three or more power supplies and the gate signal line in a prescribed period. Therefore, the voltage supplied to the gate signal line is controlled.

10 Claims, 13 Drawing Sheets

T1

GSP
1H

GCK
2H

GOUT-1

GOUT-2

GOUT-3
t

VGH1
Von
0
1H
T2

VGH2
Von
0

VGL
0

S1
Hi
OFF
ON
OFF
OFF
OFF
Lo

S2
Hi
OFF
OFF
ON
OFF
OFF
Lo

S3
Hi
ON
OFF
OFF
ON
ON
Lo
2H

GOUT
Von
0
t
t1
t2
t3

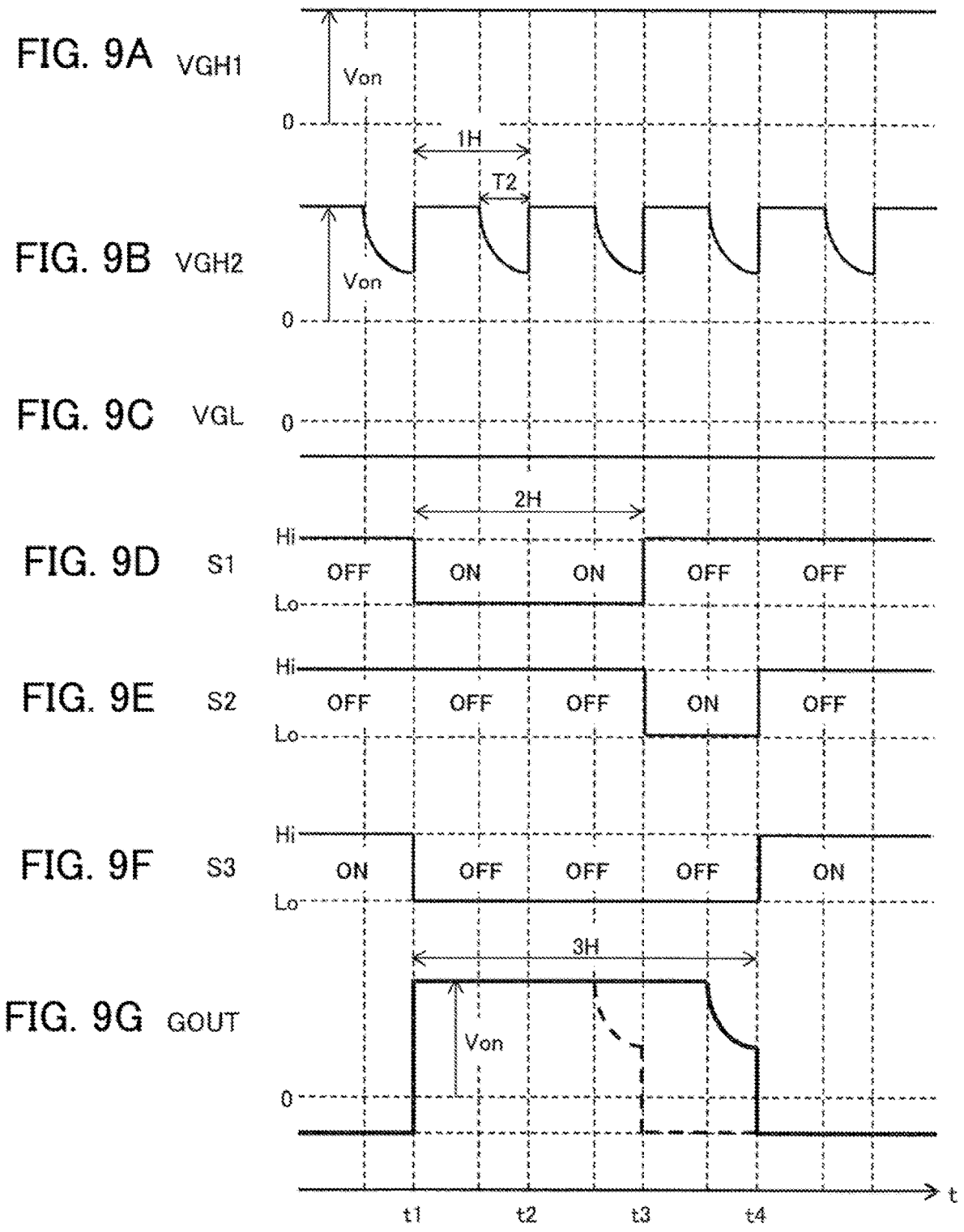
FIG. 9A VGH1
Von
0
1H
T2
FIG. 9B VGH2
Von
0
FIG. 9C VGL
0
2H
FIG. 9D S1
Hi
OFF
ON
ON
OFF
OFF
Lo
FIG. 9E S2
Hi
OFF
OFF
OFF
ON
OFF
Lo
FIG. 9F S3
Hi
ON
OFF
OFF
OFF
ON
Lo
3H
FIG. 9G GOUT
Von
0
t
t1
t2
t3
t4

VGH1
T3
T4
Von
1H
0

VGH2
Von
0

VGL
0

S1
Hi
Lo
OFF
ON
OFF
OFF
OFF

S2
Hi
Lo
OFF
OFF
ON
OFF
OFF

S3
Hi
Lo
ON
OFF
OFF
ON
ON

GOUT
2H
Von
0
t1
t2
t3
t

VGH1
T3
T4
Von
1H
0

VGH2
Von
0

VGL
0

S1
Hi
Lo
OFF
ON
OFF
OFF
OFF

S2
Hi
Lo
OFF
OFF
ON
OFF
OFF

S3
Hi
Lo
ON
OFF
OFF
ON
ON

GOUT
2H
Von
0
t1
t2
t3
t

VGH1
T3
T4
Von
1H
0

VGH2
Von
0
1H

VGH3
Von
0

VGL
0

S1
Hi
OFF
ON
OFF
OFF
OFF
Lo

S2
Hi
OFF
OFF
ON
OFF
OFF
Lo

S3
Hi
OFF
OFF
OFF
ON
OFF
Lo

S4
Hi
ON
OFF
OFF
OFF
ON
Lo
3H

GOUT
Von
0
t
t1
t2
t3
t4

VGH1
T5
T4
Von
1H
0

VGH2
Von
0
1H

VGH3
Von
0

VGL
0

S1
Hi
OFF
ON
OFF
OFF
OFF
Lo

S2
Hi
OFF
OFF
ON
OFF
OFF
Lo

S3
Hi
OFF
OFF
OFF
ON
OFF
Lo

S4
Hi
ON
OFF
OFF
OFF
ON
Lo
3H

GOUT
Von
0
t
t1
t2
t3
t4

VOLTAGE CONTROL CIRCUIT AND DISPLAY DEVICE

TECHNICAL FIELD

The present invention relates to a voltage control circuit which controls voltage to be supplied to a gate signal line of a liquid crystal panel and a display apparatus including the voltage control circuit.

BACKGROUND ART

Patent Literature 1 discloses a circuit for generating a gate pulse modulation signal which performs gate pulse modulation of voltage to be supplied to a gate signal line in a liquid crystal display apparatus. In Patent Literature 1, a circuit configuration is employed which operates by using two clock signals each having a different phase to reduce the appearance of flickers due to breaks in an output signal when driving the output signal to odd-numbered and even-numbered gate lines simultaneously. In the circuit for generating a gate pulse modulation signal of Patent Literature 1, two level shifters and two gate pulse modulators respectively using the two clock signals are provided, and control of the voltage to be supplied to the odd-numbered and even-numbered gate lines is performed separately.

CITATION LIST

Patent Literature

[Patent Literature 1]

Patent Literature 1: Japanese Patent Application Laid-Open Publication No.

SUMMARY OF INVENTION

Technical Problem

An object of the present invention is to provide a voltage control circuit and a display apparatus, the voltage control circuit capable of facilitating control of voltage to be supplied to a gate signal line of a liquid crystal panel.

Solution to Problem

A voltage control circuit according to an aspect of the present invention includes three or more power supplies and a selector switch that selects any one of the three or more power supplies to connect to a gate signal line of a liquid crystal panel. In the voltage control circuit, the selector switch controls a voltage to be supplied to the gate signal line by sequentially switching a connection of the gate signal line to any one of the three or more power supplies in a prescribed cycle.

A display apparatus according to an aspect of the present invention includes the voltage control circuit and a liquid crystal panel including a gate signal line to which a voltage controlled by the voltage control circuit is supplied.

Advantageous Effects of Invention

According to the voltage control circuit and the display apparatus of the present invention, the voltage to be supplied to the gate signal line is controlled by sequentially switching the connection of the gate line to each power supply using the selector switch. Through the above, control of the voltage to be supplied to the gate signal line of the liquid crystal panel can be facilitated.

BRIEF DESCRIPTION OF DRAWINGS

FIG. 9 is a timing diagram illustrating triple pulse operation of the voltage control circuit according to the first embodiment.

DESCRIPTION OF EMBODIMENTS

Figure 1:
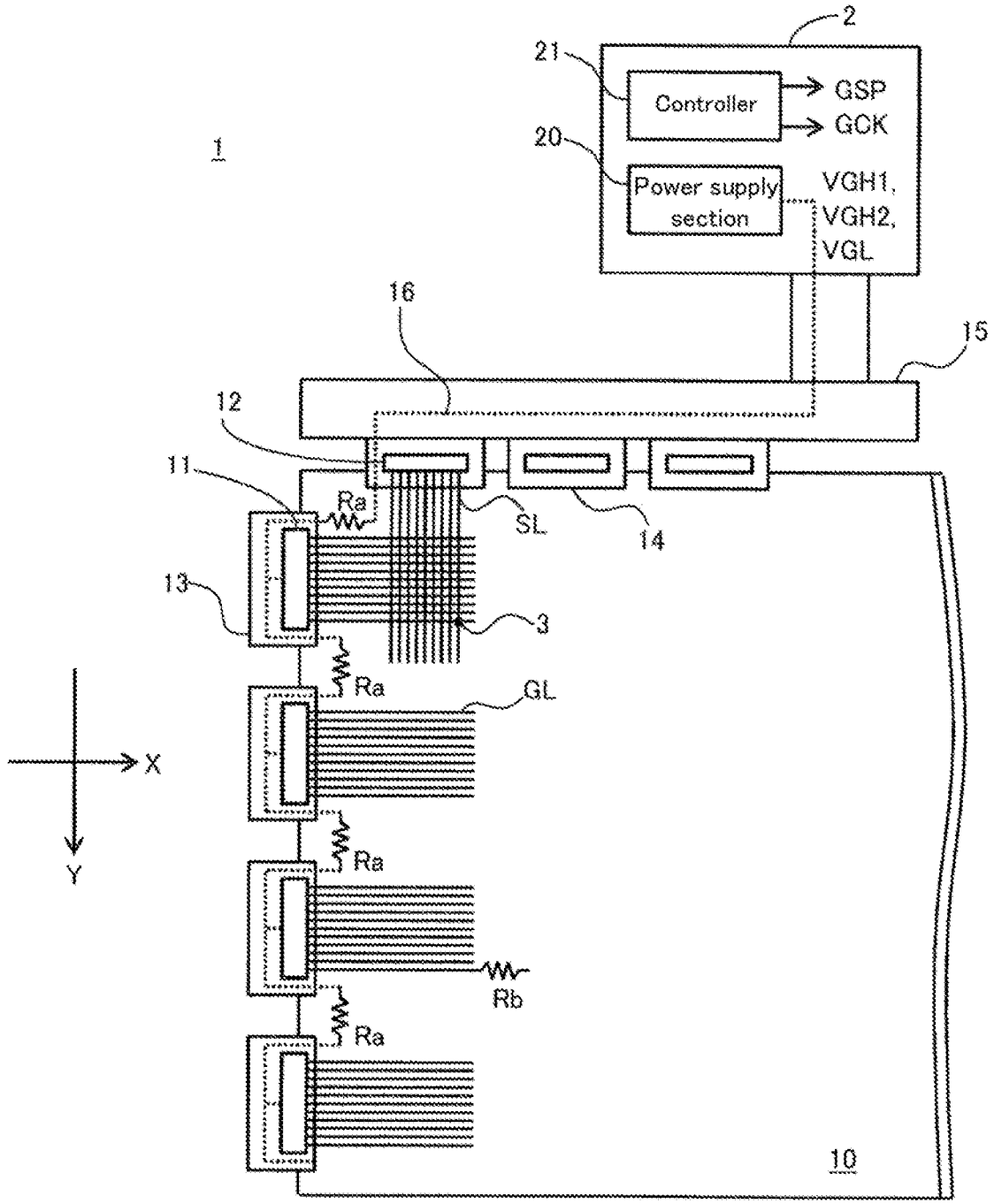
FIG. 1 is a diagram illustrating a configuration of a display apparatus according to a first embodiment of the present invention.

The following describes a voltage control circuit and a display apparatus according to embodiments of the present invention with reference to the accompanying drawings. Elements of configuration in the following embodiments that are the same are labeled with the same reference numerals.

First Embodiment

1. Configuration

The following describes a configuration of the display apparatus and a configuration of the voltage control circuit according to a first embodiment.

1-1. Configuration of Display Apparatus

The following describes the configuration of the display apparatus according to the first embodiment using FIG. 1. FIG. 1 is a diagram illustrating a configuration of a display apparatus 1 according to the present embodiment.

The display apparatus 1 according to the present embodiment constitutes a liquid crystal display apparatus such as a liquid crystal television. As illustrated in FIG. 1, the display apparatus 1 includes a liquid crystal panel 10, a plurality of gate drivers 11, a plurality of source drivers 12, a timing controller 2, and various substrates 13 to 15.

The liquid crystal panel 10 is an active matrix liquid crystal panel, for example. As illustrated in FIG. 1, the liquid crystal panel 10 includes a plurality of pixels 3, a plurality of gate signal lines GL, and a plurality of source signal lines SL. The liquid crystal panel 10 also includes such elements as a thin-film transistor (TFT) substrate with pixel electrodes, a color filter (CF) substrate with counter electrodes, a liquid crystal layer sealed between the substrates, and a polarizing plate.

The pixels 3 are for example arranged in a matrix in the liquid crystal panel 10, along a horizontal direction X and a vertical direction Y that intersect with each other. The pixels 3 respectively include active element TFTs and the like (refer to FIG. 2). A circuit configuration of each pixel 3 is described later in detail.

A gate signal line GL is connected to a gate of each TFT of pixels 3 arranged in a line (horizontal line) in the horizontal direction X in the matrix of the pixels 3, and extends in the horizontal direction X of the liquid crystal panel 10. As illustrated in FIG. 1, the gate signal lines GL are arranged side by side in the vertical direction Y of the liquid crystal panel 10. Each gate signal line GL supplies a gate signal for simultaneously selecting pixels 3 (or turning on TFTs of pixels 3) in a horizontal line.

A source signal line SL is connected to a source of each TFT of a group of pixels 3 arranged in a line in the vertical direction Y in the matrix of the pixels 3, and extends in the vertical direction Y of the liquid crystal panel 10. The source signal lines SL are arranged side by side in the horizontal direction X in the liquid crystal panel 10. A source signal line SL inputs a data signal indicating image data to each pixel 3 in a horizontal line selected by a gate signal.

The gate drivers 11 are respectively composed of for example integrated circuit (IC) chips using a chip on film (COF) method, and are individually mounted on film substrates 13. As illustrated in FIG. 1, the respective film substrates 13 are joined to an edge of the liquid crystal panel 10 in the horizontal direction X. Each gate driver 11 is connected to one end of each of some gate signal lines GL. The gate drivers 11 generate gate signals so as to scan the gate signal lines GL in the vertical direction Y. A configuration of each gate driver 11 is described later in detail.

The source drivers 12 are respectively composed of IC chips for example, and are individually mounted on film substrates 14. As illustrated in FIG. 1, the film substrates 14 are joined to the source substrate 15 and the liquid crystal panel 10. Each source driver 12 is connected to one end of each of some source signal lines SL. The source drivers 12 generate data signals to drive the source signal lines SL in parallel in synchronization with the scanning of the gate signal lines GL.

The timing controller 2 is composed of for example one or more semiconductor integrated circuits using large-scale integration (LSI). The timing controller 2 controls operation timing of elements such as the gate drivers 11 and the source drivers 12. The timing controller 2 may also control overall operation of the display apparatus 1. As illustrated in FIG. 1, the timing controller 2 includes a power supply section 20 and a controller 21.

The power supply section 20 includes a plurality of power supplies which generate various power supply voltages VGH1, VGH2, and VGL. The various power supply voltages VGH1, VGH2, and VGL are supplied to each gate driver 11 through respective voltage supply lines 16. As illustrated in FIG. 1, the voltage supply lines 16 are wired so as to pass through elements such as the source substrate 15, the liquid crystal panel 10, and the film substrates 13. The various power supplies included in the power supply section 20 are described later in detail.

The controller 21 controls overall operation of the timing controller 2. The controller 21 includes for example a microprocessor unit (MPU) or a central processing unit (CPU) which implements a prescribed function in cooperation with software, and internal memory such as flash memory. The controller 21 reads out data and programs stored in the internal memory to perform various computing processes and generate various signals.

For example, the controller 21 generates a start timing signal GSP and a gate clock signal GCK. The start timing signal GSP is a signal indicating a timing at which one frame of an image displayed on the display apparatus 1 is started. The gate clock signal GCK is a signal indicating a timing at which the gate signal lines GL are sequentially scanned in the vertical direction Y.

Note that the controller 21 may also be a hardware circuit such as a dedicated electronic circuit or a reconfigurable electronic circuit designed to implement the prescribed function. The controller 21 may also be composed of various semiconductor integrated circuits such as a CPU, an MPU, a microcomputer, a digital signal processor (DSP), a field-programmable gate array (FPGA), or an application-specific integrated circuit (ASIC).

1-1-1. Circuit Configuration of Pixel

Figure 2:
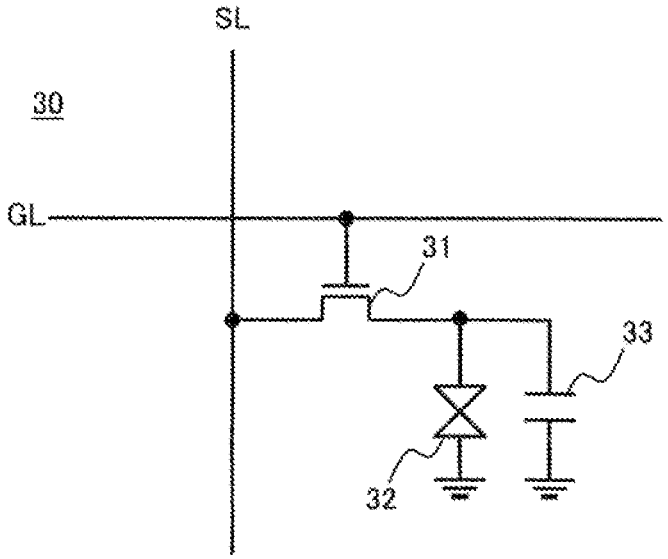
FIG. 2 is a diagram illustrating an equivalent circuit of a pixel in the display apparatus.

The following describes a circuit configuration of each pixel 3 in the liquid crystal panel 10 of the display apparatus 1 with reference to FIG. 2. FIG. 2 a diagram illustrating an equivalent circuit (hereafter referred to as a "pixel circuit" 30) of the pixel 3 in the display apparatus 1. As illustrated in FIG. 2, the pixel circuit 30 includes a TFT 31, a pixel capacitor 32, and a storage capacitor 33.

In the TFT 31 of the pixel circuit 30, a gate is connected to a gate signal line GL, a source is connected to a source signal line SL, and a drain is connected to one end of the pixel capacitor 32 and one end of the storage capacitor 33. Another end of the pixel capacitor 32 and another end of the storage capacitor 33 are grounded to for example a counter electrode in the liquid crystal panel 10.

The TFT 31 turns on when voltage applied to the gate according to a gate signal from the gate signal line GL is equal to or greater than a prescribed threshold voltage and turns off when the voltage is less than the threshold voltage. The threshold voltage of the TFT 31 is 2 to 3 V, for example. The TFT 31 is an example of a transistor connected to the gate signal line GL.

The pixel capacitor 32 is composed of a liquid crystal layer and a pixel electrode, and changes an orientation state of the liquid crystal layer according to an amount of charge. The pixel capacitor 32 charges or discharges an electric charge based on voltage of a data signal input from the source signal line SL While the TFT 31 is on. While the TFT 31 is off, the pixel capacitor 32 holds the amount of charge obtained by charging or discharging before the TFT 31 was switched off.

The storage capacitor 33 is a capacitive element for holding the amount of charge (charge voltage) held by the pixel capacitor 32. The storage capacitor 33 charges and discharges an electric charge at the same timing as the charging and discharging by the pixel capacitor 32.

According to the pixel circuit 30, when voltage equal to or greater than the threshold voltage of the TFT 31 is applied from the gate signal line GL, charging and discharging of the pixel capacitor 32 is possible, and the pixel circuit 30 is selected as an input target of the data signal. An amount of charge (charge voltage) for displaying a corresponding pixel in the image data is charged or discharged according to the data signal input from the source signal line SL to the selected pixel circuit 30.

1-1-2. Configuration of Gate Driver

Figure 3:
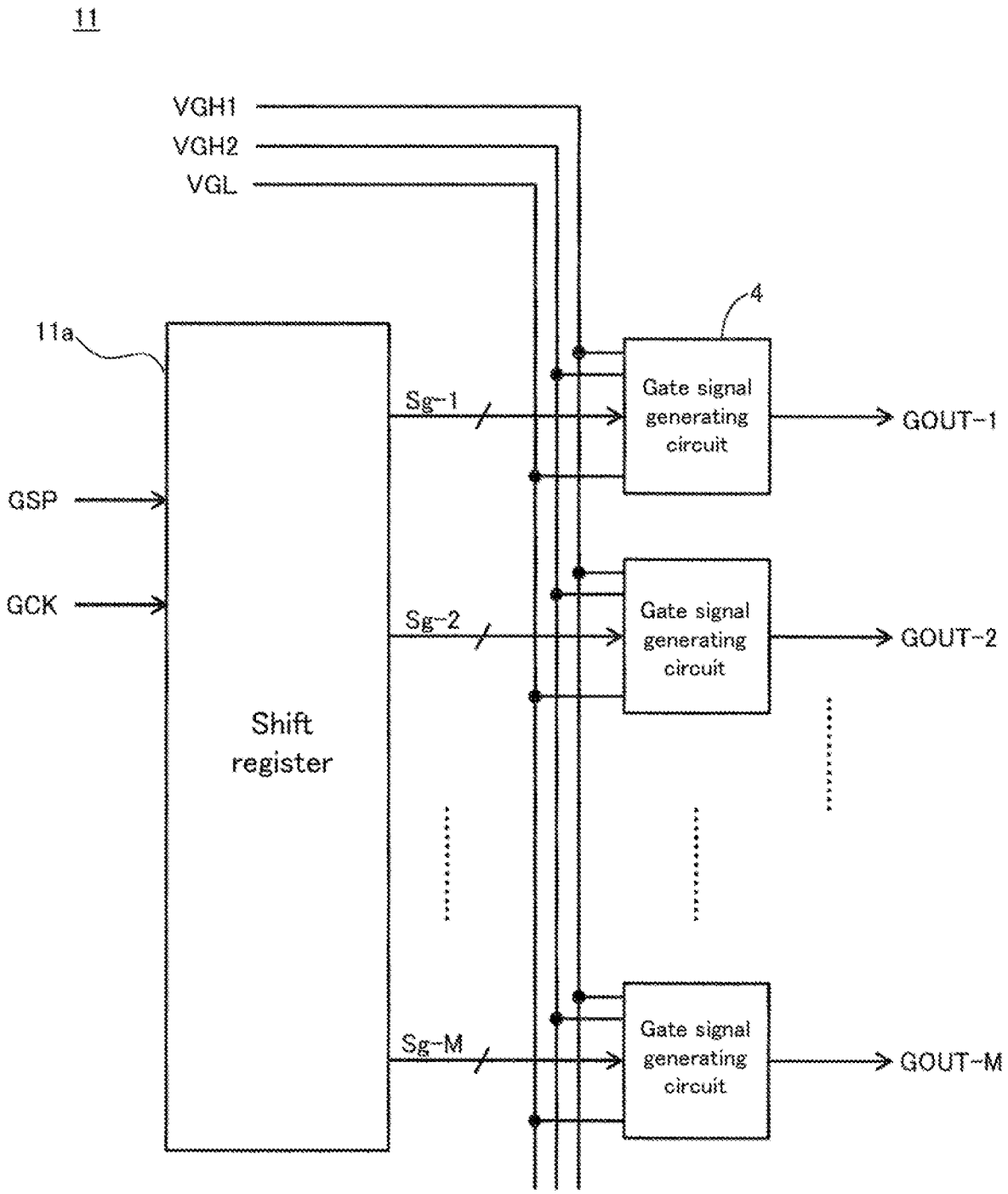
FIG. 3 is a block diagram illustrating a gate driver in the display apparatus.

The following describes a configuration of each gate driver 11 in the display apparatus 1 with reference to FIG. 3. FIG. 3 is a block diagram illustrating the gate driver 11 in the display apparatus 1.

As illustrated in FIG. 3, the gate driver 11 includes a shift register 11*a* and a plurality M of gate signal generating circuits 4. Each gate signal generating circuit 4 is connected to a respective gate signal line GL.

The shift register 11*a* generates M timing signals Sg-1, Sg-2, . . . , and Sg-M based on the start timing signal GSP and the gate clock signal GCK from the controller 21 (FIG. 1) of the display apparatus 1. The M timing signals Sg-1 to Sg-M are signals indicating a timing that is shifted at each clock cycle of the gate clock signal GCK in order from the first timing signal Sg-1. An mth (m being a natural number less than or equal to M) timing signal Sg-m is input to a gate signal generating circuit 4 connected to an math gate signal line GL arranged in the vertical direction Y of the liquid crystal panel 10. Note that one or more signal lines may be configured for each of the timing signals Sg-1 to Sg-M, a plurality of pulse signals may be included in each timing signal Sg-m (refer to FIG. 5C) for example, and as many signal lines may be configured as necessary.

Each gate signal generating circuit 4 generates gate signals GOUT-1, GOUT-2, . . . , and GOUT-M using the various power supply voltages VGH1, VGH2, and VGL supplied from the power supply section 20 based on the respectively input timing signals Sg-1, Sg-2, . . . , and Sg-M. The mth gate signal GOUT-m in the M gate signals GOUT-1 to GOUT-M is supplied to the mth gate signal line GL in the vertical direction Y of the liquid crystal panel 10. A circuit configuration of each gate signal generating circuit 4 is described later in detail.

In the following, the timing signals Sg-1, Sg-2, . . . , and Sg-M in the stated order generated by the shift register 11*a* may be generically referred to as a "timing signal Sg". Furthermore, the gate signals GOUT-1, GOUT-2, . . . , and GOUT-M in the stated order may be generically referred to as a "gate signal GOUT".

1-2. Configuration of Voltage Control Circuit.

Figure 4:
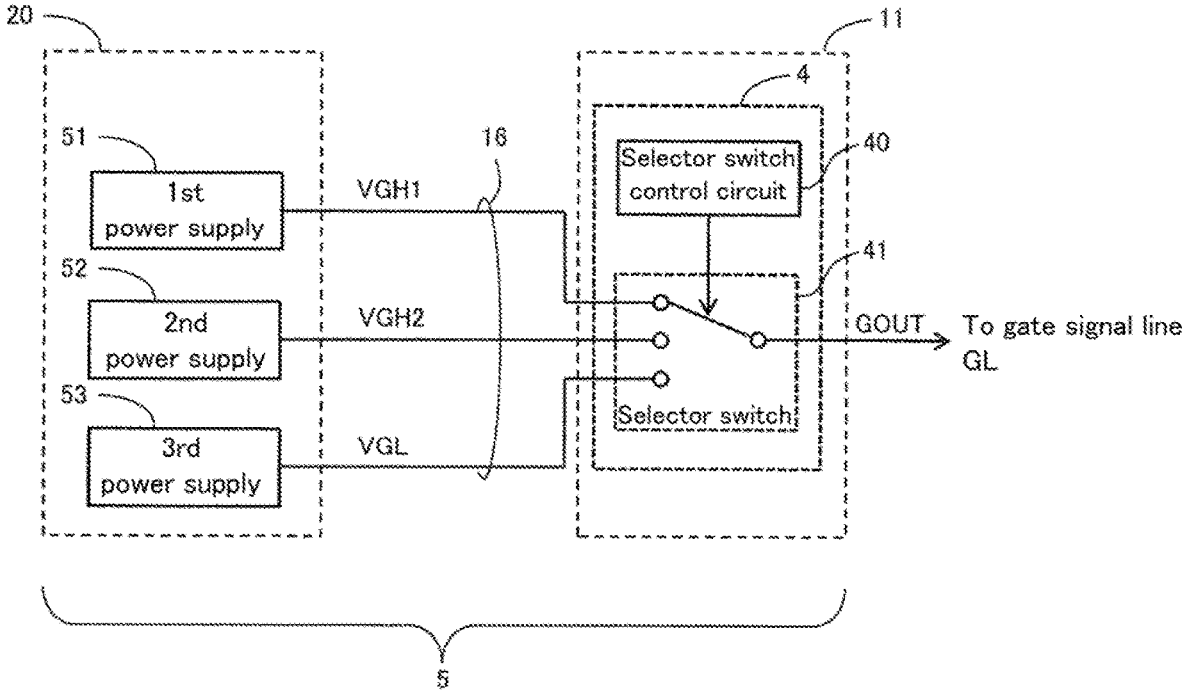
FIG. 4 is a block diagram of a voltage control circuit in the display apparatus according to the first embodiment.

The following describes the configuration of the voltage control circuit according to the present embodiment with reference to FIG. 4. FIG. 4 shows: the power supply section 20 including first, second, and third power supplies 51, 52, and 53; a gate driver 11; and a gate signal generating circuit 4 included in the gate driver 11. According to the present embodiment, a circuit including the first to third power supplies 51 to 53 and the gate signal generating circuit 4 is referred to as a "voltage control circuit" 5. FIG. 4 is a block diagram of the voltage control circuit 5 in the display apparatus 1 according to the first embodiment.

The voltage control circuit 5 in the display apparatus 1 (FIG. 1) is a circuit which controls the voltage of the gate signal GOUT supplied to a gate signal line GL. As illustrated in FIG. 4, the gate signal generating circuit 4 in the voltage control circuit 5 according to the present embodiment includes a selector switch 41 and a selector switch control circuit 40.

In the voltage control circuit 5, the first to third power supplies 51, 52, and 53 are provided in the power supply section 20 of the timing controller 2 in the display apparatus 1 of FIG. 1. The gate signal generating circuit 4 is provided in the gate driver 11 (refer to FIG. 3). Three voltage supply lines 16 corresponding to the first to third power supplies 51, 52, and 53 are respectively wired from the power supplies 51, 52, and 53 to the gate signal generating circuit 4 (refer to FIG. 1).

The first, second, and third power supplies 51, 52, and 53 respectively generate the first, second, and third power supply voltages VGH1, VGH2, and VGL. The first, second, and third power supply voltages VGH1, VGH2, and VGL are supplied to the gate signal generating circuit 4 through the respective voltage supply lines 16.

According to the present embodiment, the first power supply voltage VGH1 is a constant voltage of 20 V to 35 V, for example. As described later, the second power supply voltage VGH2, is a cyclically fluctuating voltage of a prescribed waveform. The third power supply voltage VGL is a constant voltage of −15 V to −6 V, for example. The first and third power supplies 51 and 53 are respectively composed of constant voltage sources. An example of a configuration of the second power supply 52 is described later in detail.

In the gate signal generating circuit 4, the selector switch 41 selects one of the first to third power supplies 51, 52, and 53 and connects the selected power supply to the gate signal line GL, which in other words causes the selected power supply to conduct to the gate signal line GL. Through the selector switch 41, any of the first to third power supply voltages VGH1, VGH2, and VGL is selectively supplied to the gate signal line GL.

The selector switch control circuit 40 controls selection operation by the above selector switch 41. The selector switch control circuit 40 is composed of a logic circuit, for example.

1-2-1. Configuration of Gate Signal Generating Circuit

Figure 5A:
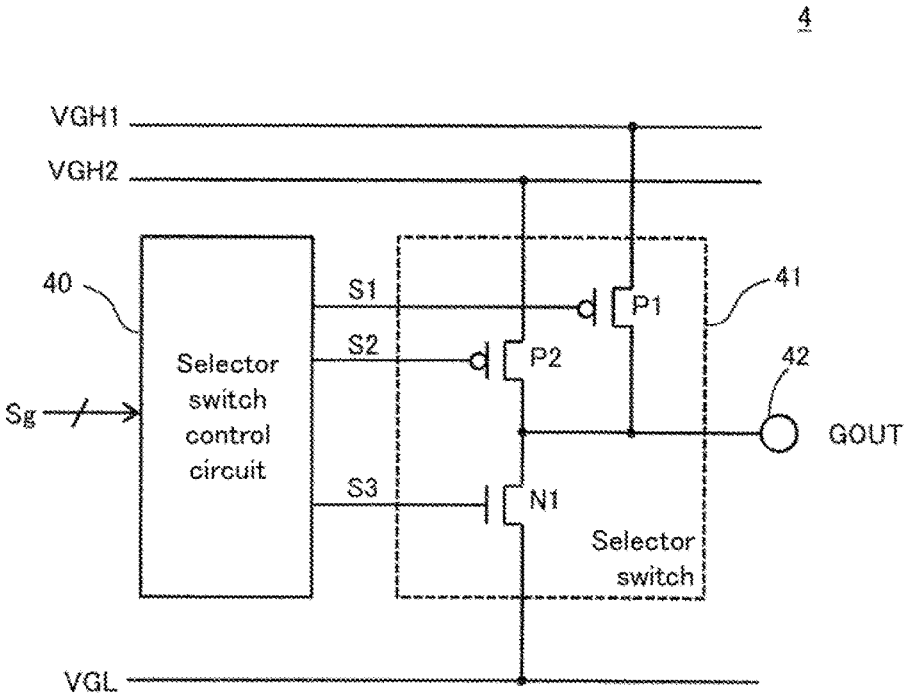
FIG. 5A is a circuit diagram illustrating a gate signal generating circuit in the voltage control circuit according to the first embodiment.

The following describes in detail the configuration of the gate signal generating circuit 4 in the voltage control circuit 5 using FIG. 5A. FIG. 5A is a circuit diagram illustrating the gate signal generating circuit 4 in the voltage control circuit 5 according to the present embodiment.

As illustrated in FIG. 5A, the selector switch 41 in the gate signal generating circuit 4 includes first, second, and third transistors P1, P2, and N1. According to the present embodiment, the first and second transistors P1 and P2 are p-type metal-oxide-semiconductor (PHOS) transistors, and the third transistor N1 is an n-type metal-oxide-semiconductor (NMOS) transistor. The first to third transistors P1, P2, and N1 are an example of switching elements respectively corresponding to the first to third power supplies 51, 52, and 53.

The first transistor P1 is connected to the voltage supply line of the first power supply voltage VGH1 and an output terminal 42 to which the gate signal generating circuit 4 outputs the gate signal GOUT. The second transistor P2 is connected to the voltage supply line of the second power supply voltage VGH2 and the output terminal 42. The third transistor N1 is connected to the voltage supply line of the third power supply voltage VGL and the output terminal 42. Therefore, the mutually different power supply voltages VGH1, VGH2, and VGL are respectively applied to one end of each of the transistors P1, P2, and N1 constituting the selector switch 41, while the other end of each transistor is connected in common.

The selector switch control circuit 40 performs logic computation based on the timing signal Sg from the shift register 11*a* (FIG. 3) of the gate driver 11 and generates first, second, and third control signals S1, S2, and S3. The first, second, and third control signals S1, S2, and S3 are signals which turn the respective first, second, and third transistors P1, P2, and N1 on and off, and are input to the gates of the transistors P1, P2, and N1.

Through the first to third control signals S1 to S3 from the selector switch control circuit 40 turning any one of the first to third transistors P1, P2, and N1 on, the one of the first to third transistors P1, P2, and N1 functions as the selector switch 41. Under the control of the selector switch 41, the gate signal generating circuit 4 generates the gate signal GOUT based on the first, second, or third power supply voltage VGH1, VGH2, or VGL, and outputs the gate signal GOUT from the output terminal 42.

Figure 5B:
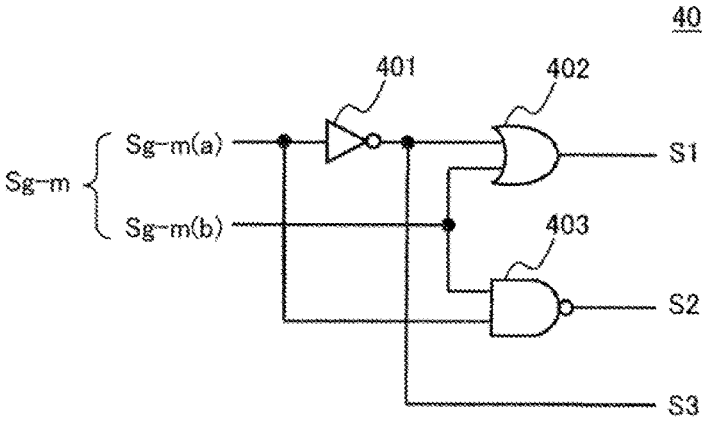
FIG. 5B is a circuit diagram illustrating an example of a selector switch control circuit in the gate signal generating circuit.
Figure 5C:
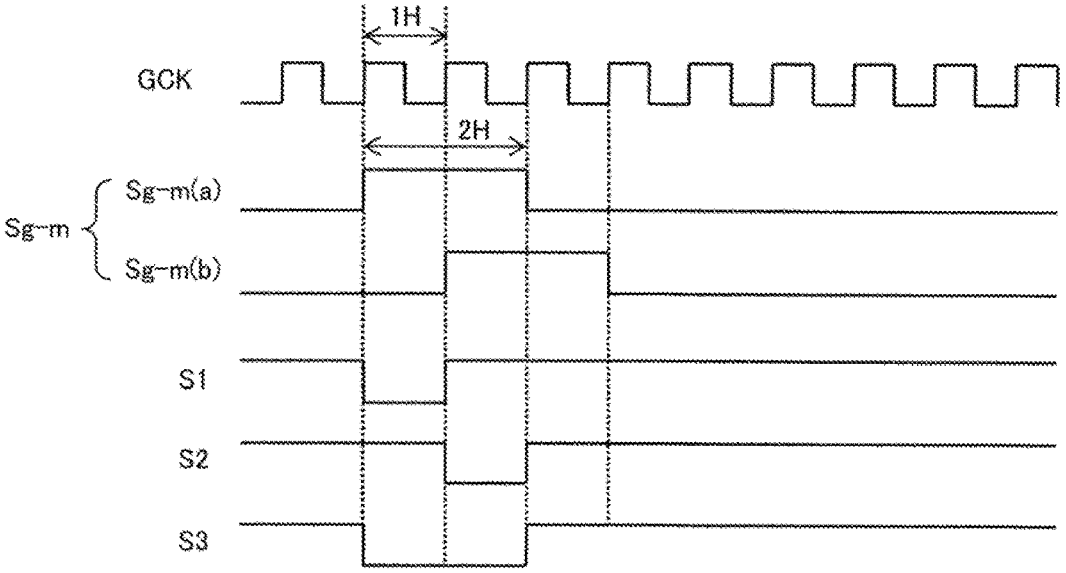
FIG. 5C is a timing diagram of various signals in the selector switch control circuit of FIG. 5B.

FIG. 5B illustrates an example of the circuit configuration of the selector switch control circuit 40. FIG. 5C is a timing diagram of various signals in the selector switch control circuit 40 in FIG. 5B. As illustrated in FIG. 5B, the selector switch control circuit 40 of the present example is composed of a logic circuit including a NOT gate 401, an OR gate 402, and a NAND gate 403. In the present example as illustrated in FIG. 5C, the timing signal Sg-m generated by the shift register 11*a* includes two pulse signals Sg-m(a) and Sg-m(b) with 2H pulse widths that differ in phase. According to the selector switch control circuit 40 of the present example, logic computation is performed based on the various gates 401 to 403 (FIG. 5B), and as illustrated in FIG. 5C, the control signals S1 to S3 can be generated to turn the first to third transistors P1, P2, and N1 on and off from the pulse signals Sg-m(a) and Sg-m(b).

1-2-2. Example Configuration of Power Supply

Figure 6:
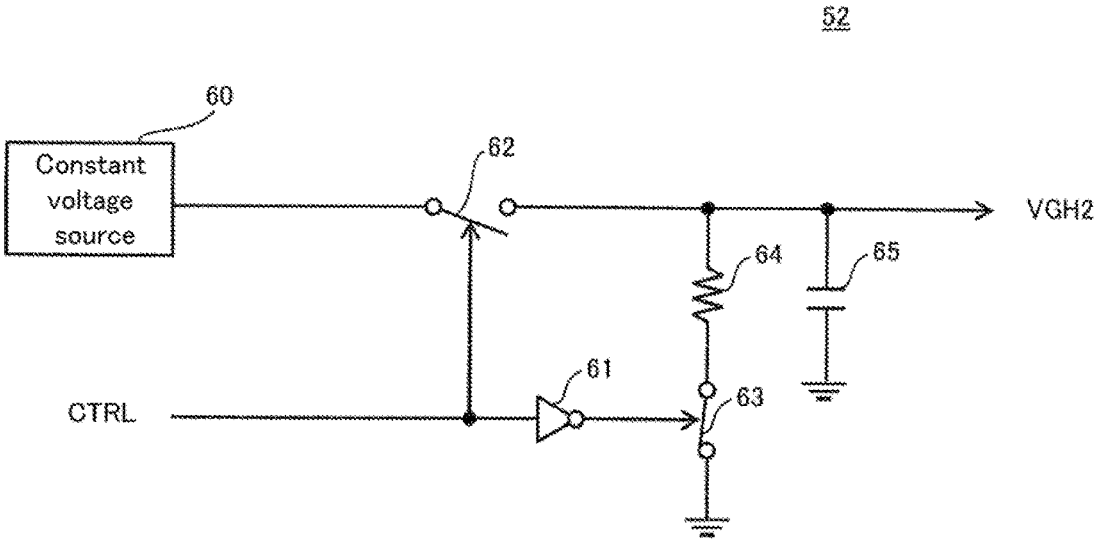
FIG. 6 is a circuit diagram illustrating an example of a power supply in the voltage control circuit.

The following describes an example of configuration of the second power supply 52 in the voltage control circuit 5 according to the present embodiment using FIG. 6. FIG. 6 is a circuit diagram illustrating an example of the second power supply 52 in the voltage control circuit 5. In the following, an example is described in which the second power supply 52 is configured using a resistor-capacitor (RC) circuit.

In the example in FIG. 6, the second power supply 52 includes a constant voltage source 60, and an inverter element 61, a charge switch 62, a discharge switch 63, a resistor 64, and a capacitor 65. The constant voltage source 60 for example generates a constant voltage of the same voltage level (20 V to 35 V for example) as the first power supply voltage VGH1. Herein, the capacitor 65 includes for example parasitic capacitance of a line (voltage supply line) of the second power supply voltage VGH2 in the liquid crystal panel 10.

The charge switch 62 is connected to the constant voltage source 60 and one end of the resistor 64. The other end of the resistor 64 is grounded through the discharge switch 63. One end of the capacitor 65 is also connected to the one end of the resistor 64, and the other end of the capacitor 65 is grounded. Through the above, an RC circuit is composed of the resistor 64 and the capacitor 65 in the second power supply 52.

The second power supply 52 as above operates for example based on a control signal CTRL generated by the controller 21. The control signal CTRL from the controller 21 is input to the charge switch 62 and is input to the discharge switch 63 through the inverter element 61. Through the above, the charge switch 62 and the discharge switch 63 are controlled so as to alternately turn on and off. The control signal CTRL is for example a signal that is at a high level for a prescribed time interval shorter than a later described single horizontal synchronization period 1H for each single horizontal synchronization period 1H.

In the second power supply 52 of the example in FIG. 6, the constant voltage from the constant voltage source 60 charges the capacitor 65 and is output as the second power supply voltage VGH2 when the charge switch 62 is on and the discharge switch 63 is off. By contrast, the electric charge charged to the capacitor 65 is discharged through the resistor 64 when the charge switch 62 is off and the discharge switch 63 is one Through the above, the voltage level of the second power supply voltage VGH2 falls in a slope shape from the voltage level at the constant voltage source 60 according to a time constant of the above RC circuit.

Figures 8A, 8B, 8C, 8D, 8E, 8F, 8G:
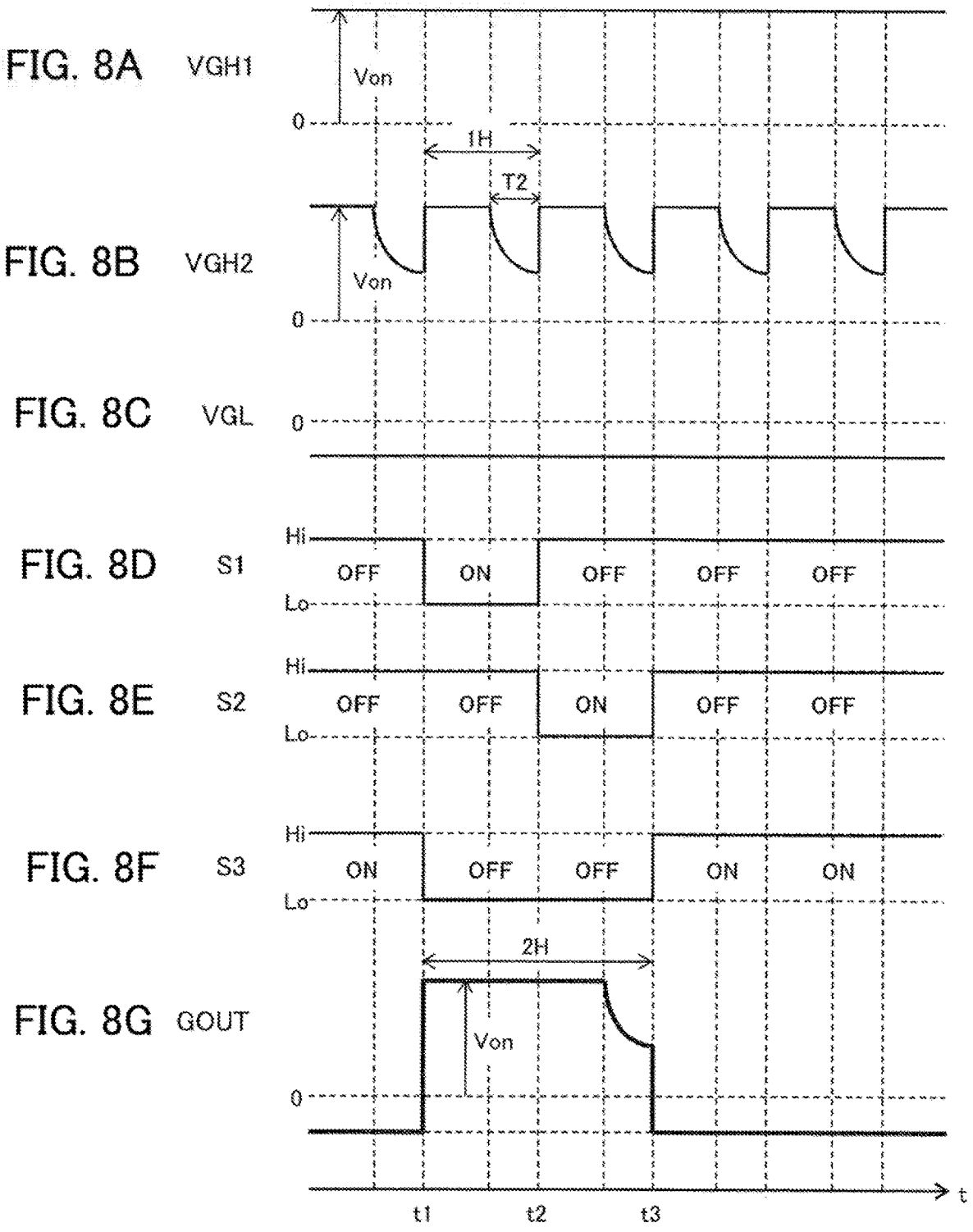
FIG. 8 is a timing diagram illustrating double pulse operation of the voltage control circuit according to the first embodiment.

Through on/off control of the above charge switch 62 and the discharge switch 63 cyclically repeating according to the control signal CTRL, the second power supply voltage VGH2 is generated in a voltage waveform with a cyclical fall (refer to FIG. 8B).

2. Operation

The following describes operation of the display apparatus 1 and the voltage control circuit 5 configured as above.

2-1. Operation of Display Apparatus

The following describes the operation of the display apparatus 1 according to the present embodiment with reference to FIG. 7. FIG. 7 is a timing diagram illustrating an example of the operation of the display apparatus 1 according to the present embodiment.

Figures 7A, 7B, 7C, 7D, 7E:
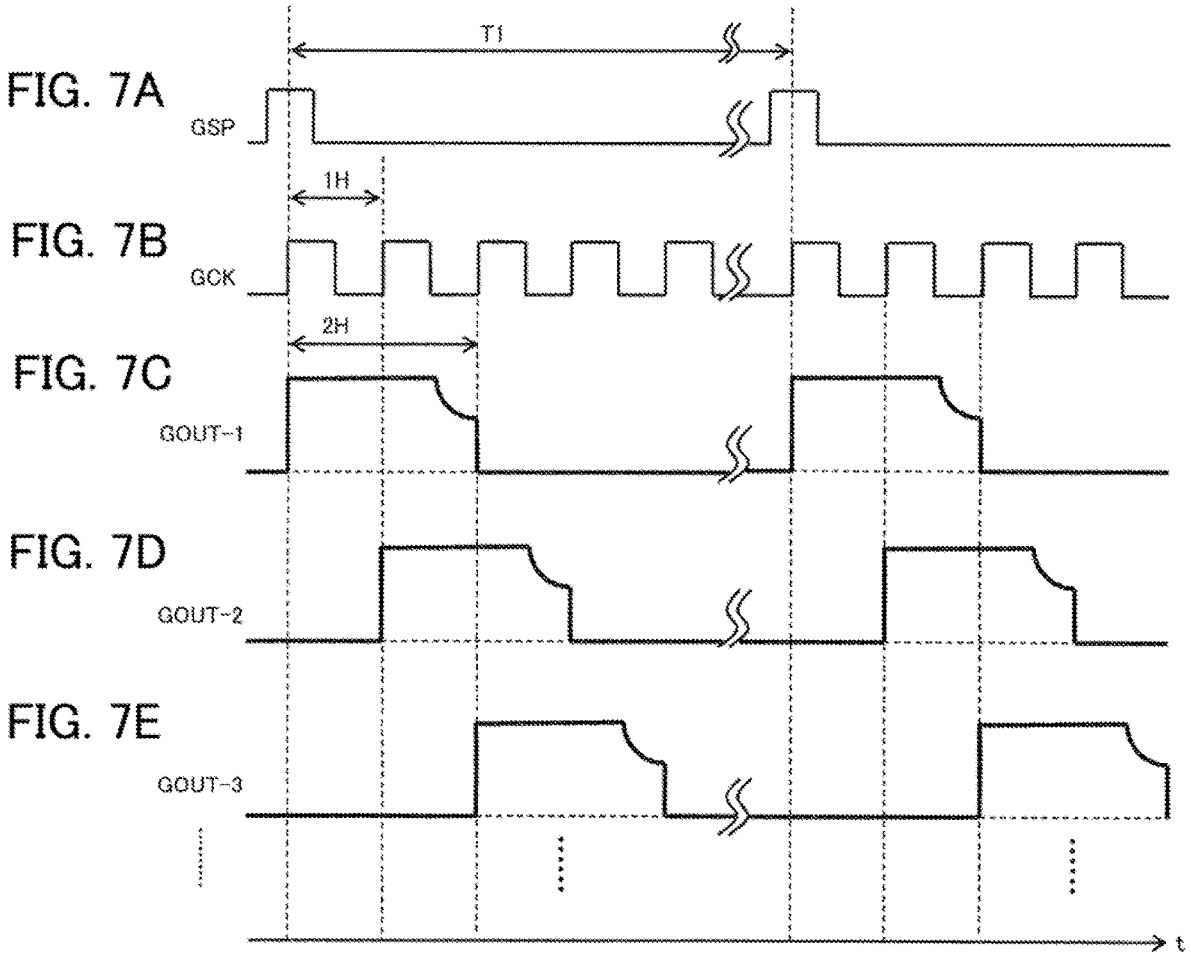
FIG. 7 is a timing diagram illustrating an example of operation of the display apparatus according to the first embodiment.

FIG. 7A illustrates input timing of the start timing signal GSP. FIG. 7B illustrates supply timing of the gate clock signal GCK. FIGS. 7C to 7E respectively illustrate examples of output timing of the first, second, and third gate signals GOUT-1, GOUT-2, and GOUT-3.

As illustrated in FIG. 7A, the controller 21 (FIG. 1) of the display apparatus 1 generates the start timing signal GSP indicating the start timing of a frame for each single frame period T1. A single frame period T1 is a period in which a single frame of an image is displayed on the liquid crystal panel 10, and is 1/60 of a second, for example. In the single frame period T1, the gate signal lines GL arranged side by side in the vertical direction Y of the liquid crystal panel 10 are sequentially scanned. The generated start timing signal GSP is input to the gate drivers 11.

As illustrated in FIG. 7B, the controller 21 supplies the gate clock signal GCK to the gate drivers 11. The gate clock signal GCK defines a single horizontal synchronization period 1H as a clock cycle. The single horizontal synchronization period 1H is a basic cycle in which pixels 3 in a horizontal line connected to one gate signal line GL are synchronized, a data signal is supplied to each pixel 3 in the horizontal line, and respective pixel capacitors 32 (FIG. 2) are charged. A number of instances of the single horizontal synchronization period 1H corresponding to the number of gate signal lines GL in the liquid crystal panel 10 is included in the single frame period T1.

In each gate driver 11, the shift register 11*a* (FIG. 3) generates the timing signals Sg-1, Sg-2, Sg-3, and so forth indicating timing per single horizontal synchronization period 1H from the timing indicated by the start timing signal GSP. The gate signal generating circuits 4 generate voltage pulses (hereafter referred to as "gate pulses") in each gate signal GOUT-1, GOUT-2, GOUT-3, and so forth based on the respective timing signals Sg-1, Sg-2, Sg-3, and so forth. Through the above, as illustrated in FIGS. 7C to 7E, the gate pulses in the gate signals GOUT-1, GOUT-2, and GOUT-3 sequentially rise in each single horizontal synchronization period 1H.

FIGS. 7C to 7E illustrate examples of operation (hereafter referred to as "double pulse operation") in which the pulse width of the gate pulses in each of the gate signals GOUT-1 to GOUT-3 is set to a period twice as long as a single horizontal synchronization period 1H, which is in other words a double pulse period 2H. Data signals to the horizontal lines of the pixels 3 connected to the respective gate signal lines GL are supplied in a latter-half single horizontal synchronization period 1H in a double pulse period 211 of each gate pulse. A former-half single horizontal synchronization period 1H is a period in which preliminary charging of the pixel capacitors 32 is performed using a data signal for a horizontal line of adjacent pixels 3.

For example, in FIGS. 7C and 7D, the timing of a former-half single horizontal synchronization period in a gate pulse of the second gate signal GOUT-2 overlaps with a latter-half single horizontal synchronization period 1H in a gate pulse of the first gate signal GOUT-1. Through the above, the pixel capacitors 32 in a horizontal line of pixels 3 associated with the second gate signal GOUT-2 can be precharged using the data signal for a horizontal line of pixels 3 associated with the first gate signal GOUT-1.

According to the present embodiment, a fall of the gate pulses in each of the gate signals GOUT-1, GOUT-2, and GOUT-3 is a slope-shaped voltage waveform (hereafter referred to as a "gate slope") as illustrated in FIGS. 7C to 7E. Due to the gate slopes in the gate pulses, luminance fluctuation caused by charge errors resulting from electric charge draw (feed through) occurring when charging of each pixel capacitor 32 finishes can be reduced.

The gate pulses in each of the gate signals GOUT-1, GOUT-2, and so forth as above are controlled by the voltage control circuit 5 (FIG. 4) in the display apparatus 1. The following describes operation of the voltage control circuit 5 according to the present embodiment.

2-2. Operation of Voltage Control Circuit 2-2-1. Outline of Operation

The following describes an outline of the operation of the voltage control circuit 5 according to the present embodiment with reference to FIGS. 1 and 7.

Recently, there is demand for narrowing the frames of display apparatuses, and for shrinking the circuit surface area of elements such as wiring of the voltage supply lines 16. In the display apparatus 1 according to the present embodiment as illustrated in FIG. 1, the voltage supply lines 16 from the power supply section 20 are wired so as to pass through the gate drivers 11 and the liquid crystal panel 10. In the gate drivers 11, the gate pulses (FIGS. 7C to 7E) in each of the gate signals GOUT-1, GOUT-2, and so forth are generated using a common power supply voltage.

According to the wiring of the voltage supply lines 16 as described above, the voltage level of the gate pulses in the gate signal GOUT decays as a gate signal line GL gets farther from the power supply section 20 because of the influence of parasitic resistance Ra in a voltage supply line 16. The gate signal GOUT also receives influence from parasitic resistance Rb of the gate signal line GL when passing through the gate signal line GL, and the voltage waveform of the gate pulses becomes dull. In consideration of the above influence, the gate pulses in the gate signal GOUT must be set such that the charge amount of the pixel capacitors 32 (FIG. 2) can be maintained across the entire area of the liquid crystal panel 10.

In FIGS. 7C to 7E, the pulse width of the gate pulses is set to a double pulse period 2H to lengthen the charge period of a pixel capacitor 32 from the usual single horizontal synchronization period 1H. It also becomes necessary to set the pulse width to triple (3H) or quadruple (4H) the single horizontal synchronization period 1H to further lengthen the charge period of the pixel capacitor 32 corresponding to an increase in screen size or resolution of the display apparatus 1.

Herein, it is necessary to appropriately form gate slopes at the timing of the falls of the gate pulses in the individual gate signals GOUT-1, GOUT-2, and so forth when changing the pulse width of the gate pulses. A method of increasing the number of power supplies is considered as a method for appropriately forming the gate slopes. However, a narrower frame of the display apparatus 1 is difficult to implement using this method because a large-scale design change is needed due to issues such as the wiring area necessary to accommodate the number of the voltage supply lines 16 increasing in proportion to the pulse width, and furthermore, the voltage supply lines 16 are thickly wired in the peripheral portion of the panel.

Therefore, according to the present embodiment, the pulse width of the gate pulses is changeable by the selector switch 41 in the voltage control circuit 5 without particularly increasing the number of the power supplies 51 to 53, and setting of the gate pulses in the gate signal GOUT can be facilitated. The following describes the operation of the voltage control circuit 5 according to the present embodiment in detail.

2-2-2. Double Pulse Operation

The following describes the double pulse operation by the voltage control circuit 5 according to the present embodiment with reference to FIG. 8. FIG. 8 is a timing diagram illustrating the double pulse operation of the voltage control circuit 5 according to the first embodiment.

FIGS. 8A to 8C indicate supply timing of the respective first, second, and third power supply voltages VGH1, VGH2, and VGL according to the present embodiment. FIGS. 8D to 8F illustrate control timing of the respective first, second, and third control signals S1, S2, and S3. FIG. 8G illustrates output timing of the gate signal GOUT.

A reference level "0" in FIGS. 8A to 8G is for example a voltage level serving as a reference of potential which drives the liquid crystal panel 10 (same in the following). A high level "Hi" and a low level "Lo" in FIGS. 8D to 8F are voltage levels with a prescribed voltage difference (Hi>Lo) of for example 3.3 V (same in the following).

According to the present embodiment, the first power supply voltage VGH1 is a constant voltage supplied from the first power supply 51, and as illustrated in FIG. 8A, the voltage level of the first power supply voltage VGH1 is greater than the reference level "0" by a gate-on voltage Von. The gate-on voltage Von is a voltage (20 V to 35 V, for example) that is greater than the threshold voltage of the TFT 31 (FIG. 2) of a pixel 3. When the first power supply voltage VGH1 is supplied to a gate signal line GL, TFTs 31 connected to the same gate signal line GL are kept on. The first power supply voltage VGH1 is an example of a first voltage in the present embodiment.

According to the present embodiment, the second power supply voltage VGH2 is supplied from the second power supply 52 (FIG. 4) and the voltage level cyclically fluctuates in a cycle of a single horizontal synchronization period 1H as illustrated in FIG. 8B. The second power supply voltage VGH2 has a voltage change interval T2 in which the voltage level at the end of the same cycle falls in a slope shape from the same voltage level as the first power supply voltage VGH1. The voltage change interval T2 is a prescribed time interval that is shorter than a single horizontal synchronization period 1H.

According to the present embodiment, the third power supply voltage VGL is a constant voltage from the third power supply 53 (FIG. 4), and as illustrated in FIG. 8C, the voltage level of the third power supply voltage VGL is smaller than the reference level "0". When the third power supply voltage VGL is supplied to a gate signal line GL, TFTs 31 (FIG. 2) connected to the same gate signal line GL are kept off. The third power supply voltage VGL is an example of a second voltage in the present embodiment.

The first to third control signals S1, S2, and S3 in FIGS. 8D to 8F are high level before a time t1. At this time, in the first to third transistors P1, P2, and N1 (FIG. 5A) constituting the selector switch 41, only the third transistor N1 is turned on and the selector switch 41 selects the third power supply 53 from among the first to third power supplies 51 to 53 (FIG. 4). Through the above, the voltage control circuit 5 outputs the gate signal GOUT based on the third power supply voltage VGL from the third power supply 53 (FIGS. 8C and 8G).

At the time t1, the selector switch control circuit 40 switches the first control signal S1 from high level to low level as illustrated in FIG. 8D. Through the above, the first transistor P1 in the selector switch 41 (FIG. 5A) is turned on. As illustrated in FIG. 8E, the selector switch control circuit 40 continues the high level of the second control signal S2 and keeps the second transistor P2 off. As illustrated in FIG. 8F, the selector switch control circuit 40 also switches the third control signal S3 from high level to low level and turns the third transistor N1 off.

Through the switching control described above, the selector switch 41 selects the first power supply 51 from among the first to third power supplies 51 to 53 (FIG. 4). Through the above, the first power supply voltage VGH1 in FIG. 8A is output as the voltage of the gate signal GOUT as illustrated in FIG. 8G. Such a state continues during the single horizontal synchronization period 1H from the time t1 to a time t2.

At the time t2, the selector switch control circuit 40 switches the first control signal S1 to high level as illustrated in 8D and switches the second control signal S2 to low level as illustrated in FIG. 8E. At this time, the first transistor P1 is off and the second transistor P2 is on in the selector switch 41 (FIG. 5A). As illustrated in FIG. 8F, the selector switch control circuit 40 continues the low level of the third control signal S3 and keeps the third transistor N1 off.

Through the switching control described above, the selector switch 41 selects the second power supply 52 from among the first to third power supplies 51 to 53 (FIG. 4). Through the above, during the single horizontal synchronization period 1H from the time t2 to a time t3, the second power supply voltage VGH2 in FIG. 8B is output as the voltage of the gate signal GOUT as illustrated in FIG. 8G.

At the time t3, the selector switch control circuit 40 switches the second and third control signals S2 and S3 to high level as illustrated in FIGS. 8E and 8F. At this time, in the selector switch 41 (FIG. 5A), the second transistor P2 is off and the third transistor N1 is on. As illustrated in FIG. 8D, the selector switch control circuit 40 continues the high level of the first control signal S1 and keeps the first transistor P1 off.

Under switching control described above, the third power supply 53 among the first to third power supplies 51 to 53 (FIG. 4) is selected again by the selector switch 41. Through the above, as illustrated in FIG. 8G, the voltage output as the gate signal GOUT returns to the third power supply voltage VGL of FIG. 8C.

The voltage control circuit 5 repeats the above operation in a prescribed cycle (single frame period T1) based on the timing signal Sg (FIG. 4).

Through the above operation, the selector switch 41 sequentially switches the connection between the gate signal line GL and any one of the first to third power supplies 51 to 53 in a cycle of a single horizontal synchronization period 1H so that the pulse width of the gate pulse in the gate signal GOUT becomes a double pulse period 2H (FIGS. 7C to 7E).

In the double pulse period 211 from the time t1 to the time t3, the selector switch 41 selects the second power supply 52 in the latter-half single horizontal synchronization period 1H from the time t2 to the time t3 (FIG. 8E). Through the above, a gate slope is formed (FIGS. 8B and 8G) in the gate signal GOUT based on the voltage change interval T2 of the end of a single horizontal synchronization period 1H in the second power supply voltage VGH2.

In the former-half single horizontal synchronization period 1H from the time t1 to the time t2 by contrast, the selector switch 41 selects the first power supply 51 but not the second power supply 52 (FIG. 8D). Through the above, at the time t2 at which the second power supply voltage VGH2 falls (FIG. 8B), the voltage level of the gate signal GOUT becomes constant based on the first power supply voltage VGH1 (FIGS. 8A and 8G). Through the above, a gate slope is not formed in the gate signal GOUT during the former-half single horizontal synchronization period 1H, a voltage drop (break) near the middle of the gate pulse is avoided, and an adequate charge period can be ensured.

2-2-3. Triple Pulse Operation

In the above double pulse operation, the pulse width of the gate pulses is set to a double pulse period 214 (refer to FIGS. 8A to 8G). Through the voltage control circuit 5 according to the present embodiment, the pulse width of the gate pulses can be easily changed. In the following, triple pulse operation in which a gate pulse is generated with a pulse width of a triple pulse period 3H is described as an example using FIG. 9. The triple pulse period 3H is three times as long as a single horizontal synchronization period 1H.

FIG. 9 is a timing diagram illustrating the triple pulse operation of the voltage control circuit 5 according to the present embodiment. FIGS. 9A to 9C illustrate supply timing of the respective first to third power supply voltages VGH1, VGH2, and VGL according to the present embodiment. FIGS. 9D to 9F illustrate control timing of the respective first to third control signals S1, S2, and S3 for the triple pulse operation. FIG. 9G illustrates output timing of the gate signal GOUT according to the triple pulse operation.

In the case of FIGS. 8A to 8G, the selector switch control circuit 40 performs switching control of the selector switch 41 at the time t2 such that a state in which the first power supply 51 is selected continues during the single horizontal synchronization period 1H from the time t1 to the time t2. According to the present variation as illustrated in FIGS. 9D to 9F, the selector switch control circuit 40 performs the switching control described above at the time t3 after another single horizontal synchronization period 1H has elapsed from the time t2. Through the above, the state in which the first power supply 51 is selected continues during the double pulse period 2H from the time t1 to the time t3.

Through the switching control using the control signals S1 to S3 in FIGS. 9D to 9F, the selector switch 41 selects the second power supply 52 at the time t3 and selects the third power supply 53 at a time t4 after a single horizontal synchronization period 1H has elapsed from the time t3. Through the above, at the end of the single horizontal synchronization period 1H from the time t3 to the time t4, a gate slope is formed based on the second power supply voltage VGH2 (FIG. 9B) in the gate signal GOUT as illustrated in FIG. 9G.

Through the above operation, as illustrated in FIG. 9G, a gate pulse with the pulse width of a triple pulse period 3H is easily generated in the gate signal GOUT. As such, according to the voltage control circuit 5 in the present embodiment, the pulse width of the gate pulses can be easily changed by the selector switch 41.

Furthermore, at the times t2 and t3 at which the second power supply voltage VGH2 falls (FIG. 9B), the voltage level of the gate signal GOUT is constant based on the first power supply voltage VGH1 (FIG. 9A to 9G). Through the above, a gate slope is not formed in the gate signal GOUT other than at the end of a gate pulse, a voltage drop is avoided other than at the end of the gate pulse, and an adequate charge period can be ensured.

3. Summary

As described above, the voltage control circuit 5 according to the present embodiment includes the first, second, and third power supplies 51, 52, and 53, and the selector switches 41. Each selector switch 41 selects any one of the first to third power supplies 51 to 53 to connect to a gate signal line GL of the liquid crystal panel M. The selector switches 41 control the voltage of the gate signal GOUT supplied to the gate signal lines GL by sequentially switching the connection of the gate signal lines GL to any one of the first to third power supplies 51 to 53 in a prescribed cycle.

According to the above voltage control circuit 5, a power supply which supplies voltage to the gate signal lines GL is selected from the first to third power supplies 51 to 53 in the prescribed cycle using the selector switches 41, and control of the voltage of the gate signal GOUT can be facilitated. For example, the wiring of the voltage supply lines 16 can be prevented from increasing in proportion to the pulse width when the width of a gate pulse increases to 3H or 4H.

In the voltage control circuit 5 according to the present embodiment, the prescribed cycle in which selection is performed by the selector switches 41 is a single horizontal synchronization period 1H.

According to the above voltage control circuit 5, the voltage of the gate signal GOUT is controlled in a cycle of a single horizontal synchronization period 1H, and a gate pulse with a pulse width that is an integer multiple (2H or 3H, for example) of a single horizontal synchronization period can be easily generated.

In the voltage control circuit 5 according to the present embodiment, the first power supply voltage VGH1 (first voltage) among the first to third power supply voltages VGH1, VGH2, and VGL from the first to third power supplies 51 to 53 is a constant voltage which turns on TFTs 31 when applied to the gates of the TFTs 31. That is, the first power supply voltage VGH1 has a time interval (constant voltage interval) in which TFTs 31 connected to the gate signal lines GL are kept on. The third power supply voltage VGL (second voltage) among the first to third power supply voltages VGH1, VGH2, and VGL is a constant voltage which turns off the TFTs 31 when applied to the gates of the TFTs 31. That is, the third power supply voltage VGL has a time interval (constant voltage interval) in which the TFTs 31 connected to the gate signal lines GL are kept off.

According to the above voltage control circuit 5, on/off control of the TFTs 31 connected to the gate signal lines GL can be easily implemented by selecting the first power supply voltage VGH1 and the third power supply voltage VGL.

In the voltage control circuit 5 according to the present embodiment, the second power supply voltage VGH2 among the first to third power supply voltages VGH1, VGH2, and VGL from the first to third power supplies 51 to 53 has a voltage change interval T2 at the end of the prescribed cycle (single horizontal synchronization period 1H). In the voltage change interval T2, the voltage level of the second power supply voltage VGH2 approaches the voltage level of the constant voltage of the third power supply voltage VGL from the voltage level of the constant voltage of the first power supply voltage VGH1.

According to the above voltage control circuit 5, in the switching of the prescribed cycle (single horizontal synchronization period 1H), the voltage of the gate signal GOUT can be controlled so as to dull the voltage waveform of the gate signal GOUT when switching from the first power supply voltage VGH1 to the third power supply voltage VGL.

In the voltage control circuit 5 according to the present embodiment, each selector switch 41 includes the first to third transistors P1, P2, and N1 which are switching elements of the same number as the first to third power supplies 51 to 53. One end of each of the first to third transistors P1, P2, and N1 is connected to a different power supply among the first to third power supplies 51 to 53, and the other end of each of the transistors is connected in common.

According to the above voltage control circuit 5, the selector switches 41 can be implemented in a simple circuit configuration. Note that in the above description, each selector switch 41 is described with the first and second transistors P1 and P2 as PMOS transistors, and the third transistor N1 as an NMOS transistor (refer to FIG. 5A). The selector switches 41 are not limited as such, and may for example be composed of combinations of various MOS transistors.

The voltage control circuit 5 according to the present embodiment further includes the selector switch control circuits 40 each of which controls the corresponding selector switch 41 so as to sequentially switch the connection of a gate signal line GL to any one of the first to third power supplies 51 to 53 in the prescribed cycle.

According to the voltage control circuit 5 as above, voltage control of the gate signal GOUT is easily performed by controlling the selector switches 41 through the selector switch control circuits 40. Note that in the above description, the voltage control circuit 5 is described as having the gate signal generating circuits 4 each including the selector switch 41 next to the selector switch control circuit 40. However, the present invention is not limited as such, and the selector switch control circuit 40 may be implemented separately from the selector switch 41. In this case for example, it is not particularly necessary that the voltage control circuit 5 have a selector switch control circuit 40.

The display apparatus 1 according to the present embodiment includes the voltage control circuit 5 and the liquid crystal panel 10. The liquid crystal panel 10 includes the gate signal lines GL to which voltage is supplied under the control of the voltage control circuit 5.

According to the above display apparatus 1, control of the gate signal GOUT in the display apparatus 1 can be easily performed by controlling the voltage of the gate signal GOUT supplied to the gate signal lines GL by the voltage control circuit 5.

Variation of First Embodiment

According to the first embodiment as described above, an example is described in which a gate slope is generated in the fall of a gate pulse in the gate signal GOUT. In the following, a variation in which a gate slope is generated in the rise of a gate pulse is described using FIG. 10.

Figures 10A, 10B, 10C, 10D, 10E, 10F, 10G:
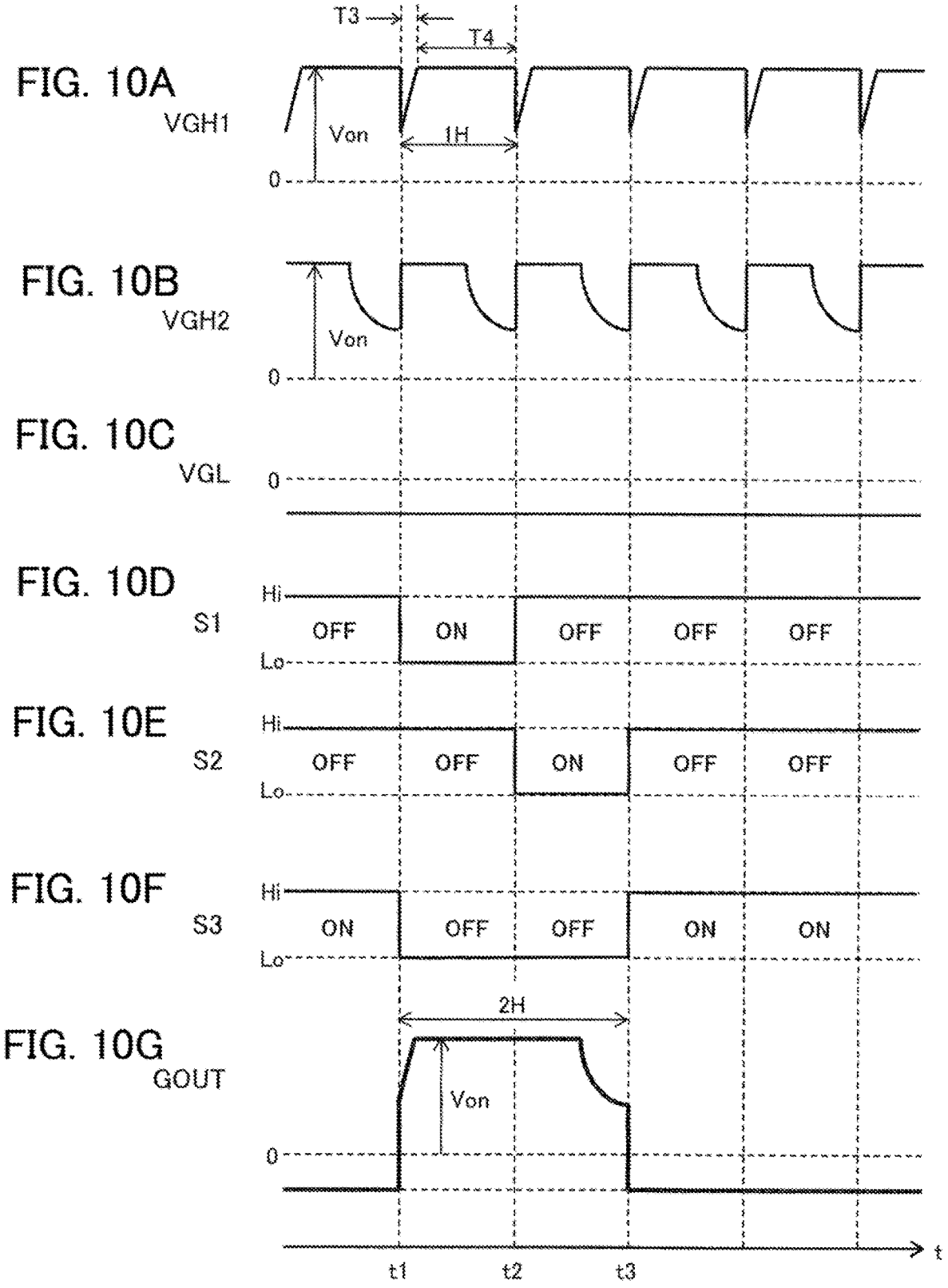
FIG. 10 is a timing diagram illustrating the operation of the voltage control circuit of a first variation of the first embodiment.

FIG. 10 is a timing diagram illustrating the operation of the voltage control circuit 5 according to a first variation of the first embodiment. FIGS. 10A to 10C illustrate supply timing of the respective first to third power supply voltages VGH1, VGH2, and VGL according to the present variation. FIGS. 10D to 10F illustrate control timing of the respective first to third control signals S1, S2, and S3. FIG. 10G illustrates output timing of the gate signal GOUT according to the present variation.

In the variation illustrated in FIGS. 10A to 10G, a first power supply voltage VGH1 is used which fluctuates in a cycle of a single horizontal synchronization period 1H as illustrated in FIG. 10A instead of the first power supply voltage VGH1. (FIG. 8A) of a constant voltage in FIGS. 8A to 8G In this case, the first power supply 51 (FIG. 4) in the voltage control circuit 5 includes a voltage modulator and a constant voltage source composed of an RC circuit, for example.

The first power supply voltage VGH1 in FIG. 10A has a voltage change interval T3 and a constant voltage interval T4 during a cycle of a single horizontal synchronization period 1H. The voltage change interval T3 is a time interval at the beginning of a single horizontal synchronization period 1H. In the voltage change interval T3, the voltage level of the first power supply voltage VGH1 changes so as to approach a voltage level that is higher than the reference level "0" by the gate-on voltage Von. The constant voltage interval T4 is a time interval in which the first power supply voltage VGH1 is kept as a constant voltage at the voltage level that is higher than the reference level "0" by the gate-on voltage Von.

The first power supply voltage VGH1 in FIG. 10A as above is selected by the selector switch 41 in the single horizontal synchronization period 1H from the time t1 to the time t2 (FIGS. 10D to 10F). Through the above, as illustrated in FIG. 10G, the rise of the gate pulse in the gate signal GOUT is formed in a slope shape.

In the display apparatus 1 (FIG. 1), rounding of the waveform of the gate pulse becomes more significant as a distance from a gate driver 11 to a pixel 3 becomes farther. As such, in the liquid crystal panel 10, the waveform of the gate voltage differs between a pixel 3 positioned at an end near the gate driver 11 and a pixel 3 positioned at the center far from the gate driver 11, and the charge amount of the pixels 3 may become uneven. By contrast, equalization of the charge amount of the pixels 3 across the entire area of the liquid crystal panel 10 can be facilitated by dulling the waveform of the gate pulse in advance as described above.

As above, the first power supply voltage VGH1 in the voltage control circuit 5 may have a voltage change interval T3 at the beginning of the prescribed cycle. In the voltage change interval T3, the voltage level approaches the voltage level (constant voltage) in the constant voltage interval T4 from the voltage level (constant voltage) of the reference level "0" or the third power supply voltage VGL. According to the voltage control circuit 5, gate pulses of various waveforms can be easily generated by appropriately setting various power supply voltages through the first to third power supplies 51 to 53.

In the variation illustrated in FIGS. 10A to 10G, a gate slope is formed in the fall of the gate pulse in the gate signal GOUT (FIG. 10G) based on the second power supply voltage VGH2 in FIG. 10B. The gate slope may be appropriately omitted according to a specification of the liquid crystal panel 10 or the like. A variation in which the gate slope is omitted is illustrated in FIGS. 11A to 11G.

Figures 11A, 11B, 11C, 11D, 11E, 11F, 11G:
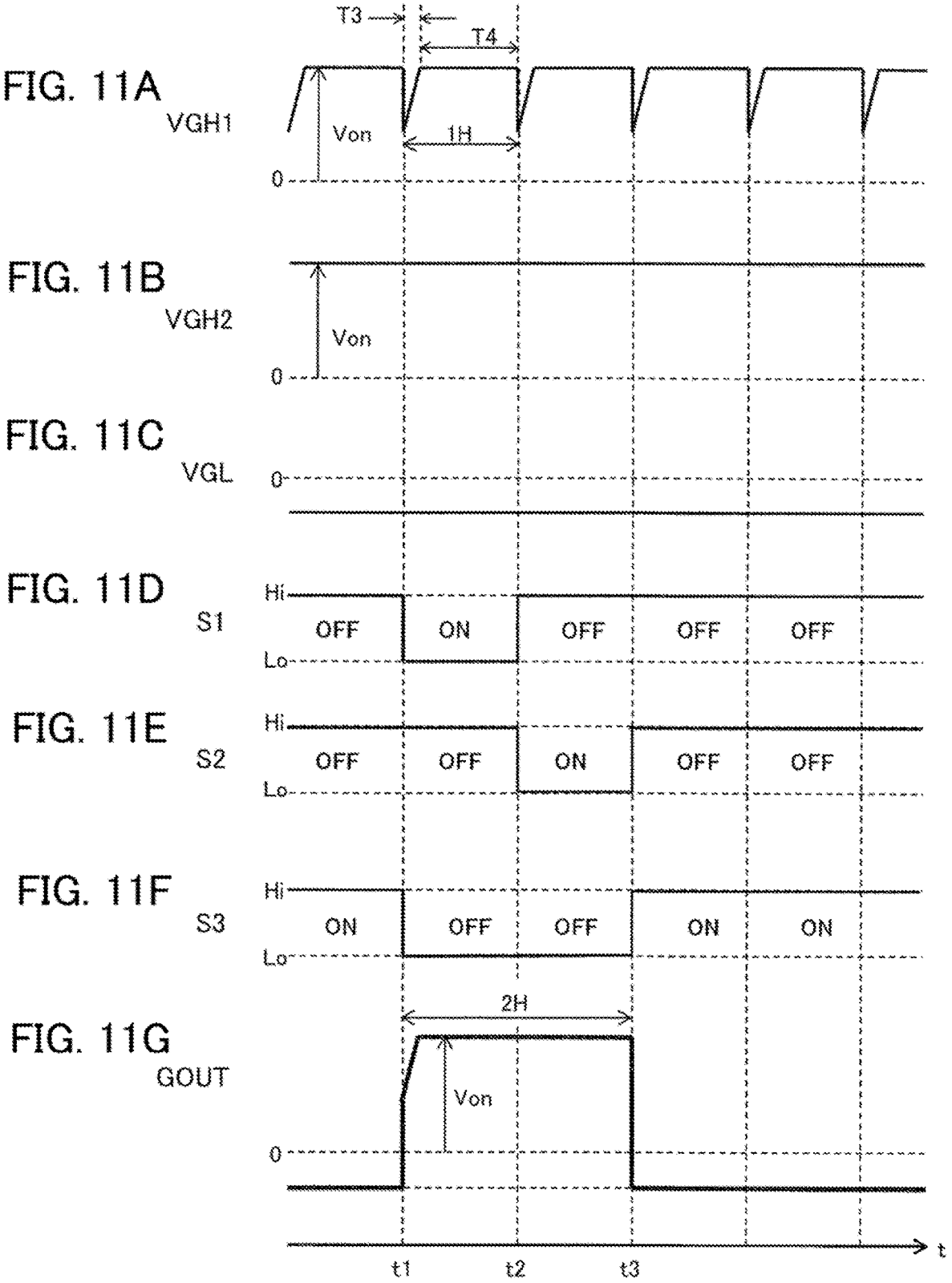
FIG. 11 is a timing diagram illustrating the operation of the voltage control circuit of a second variation of the first embodiment.

FIG. 11 is a timing diagram illustrating the operation of the voltage control circuit 5 according to a second variation of the first embodiment. FIGS. 11A to 11C illustrate supply timing of the respective first to third power supply voltages VGH1, VGH2, and VGL. In the present variation, FIGS. 11D to 11F illustrate control timing of the respective first to third control signals S1, S2, and S3. FIG. 11G illustrates output timing of the gate signal GOUT according to the present variation.

In the variation illustrated in FIGS. 11A to 11G, a second power supply voltage VGH2 of a constant voltage as illustrated in FIG. 11B is used instead of the second power supply voltage VGH2 (FIG. 10B) in FIGS. 10A to 10G. In this case, the second power supply 52 (FIG. 4) in the voltage control circuit 5 is composed of a constant voltage source or the like.

According to the variation illustrated in FIG. 11A to 11G, a voltage drop (break) near the middle of a gate pulse with a slope-shaped rise (FIG. 11G) is avoided and the pulse width can be easily changed while ensuring an adequate charge period by adjusting the period in which the second power supply voltage VGH2 (FIG. 11B) of a constant voltage is selected.

Second Embodiment

According to the first embodiment, the voltage control circuit 5 has three power supplies, but the voltage control circuit may have more than three power supplies. According to the second embodiment, a voltage control circuit with four or more power supplies is described.

Figure 12:
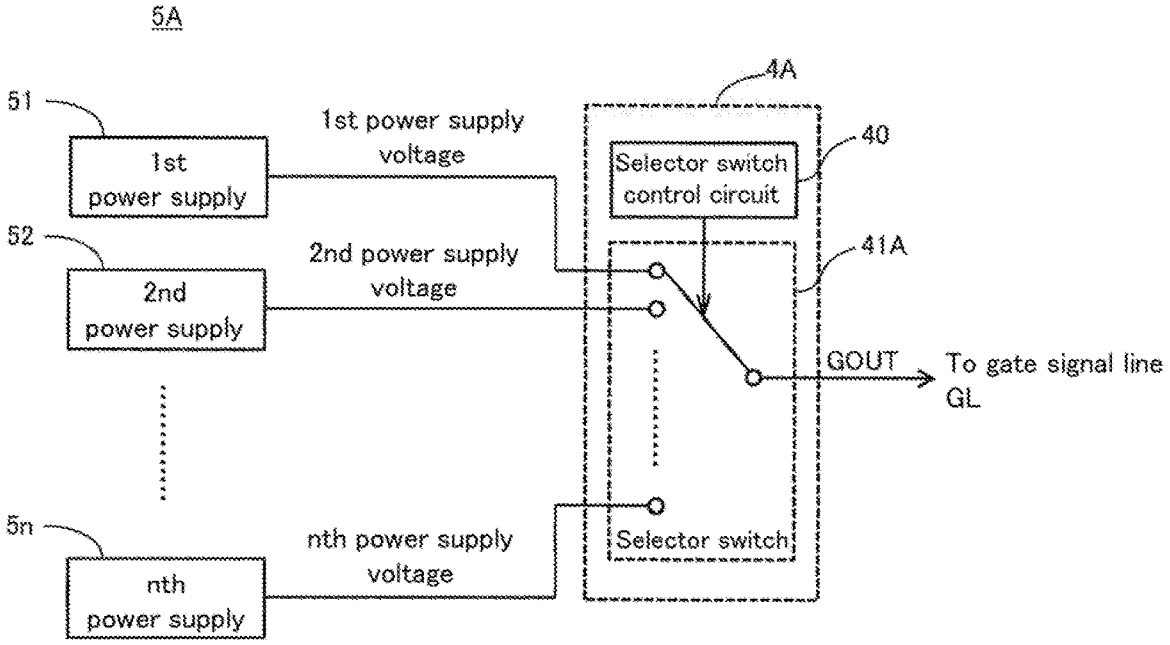
FIG. 12 is a block diagram illustrating the voltage control circuit according to a second embodiment.
Figure 13:
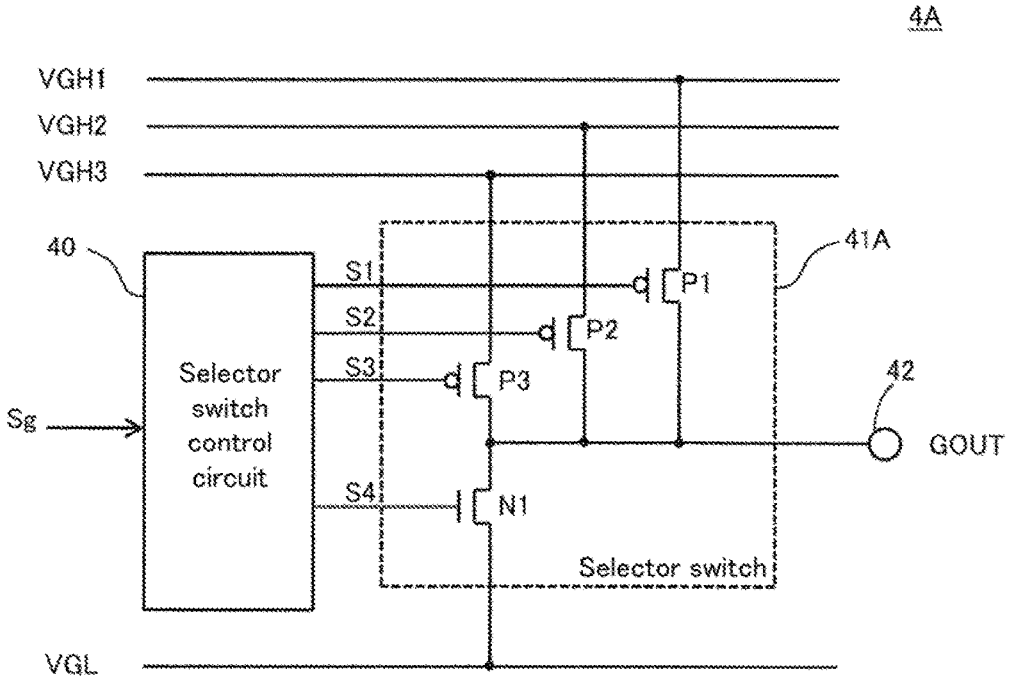
FIG. 13 is a circuit diagram illustrating an example of the gate signal generating circuit in the voltage control circuit according to the second embodiment.

The following describes a configuration of the voltage control circuit according to the present embodiment with reference to FIGS. 12 and 13. FIG. 12 is a block diagram illustrating a voltage control circuit 5A according to the second embodiment.

As illustrated in FIG. 12, the voltage control circuit 5A according to the present embodiment includes first to nth power supplies 51, 52, . . . , and 5*n* (n being an integer of at least 4) and a gate signal generating circuit 4A. The gate signal generating circuit 4A has a similar configuration to the gate signal generating circuit 4 (FIG. 4) of the first embodiment and includes a selector switch 41A which selects any one of the first to nth power supplies 51 to 5*n* instead of the selector switch 41 which selects any of the three power supplies. Similarly to the first embodiment, for example, the selector switch 41A is composed of n switching elements (MOS transistors, for example) of the same number as the first to nth power supplies 51 to 5*n*.

The first to nth power supplies 51 to 5*n* generate respective first to nth power supply voltages. Similarly to the first embodiment, the first to nth power supplies 51 to 5*n* are supplied to the gate signal generating circuit 4A through respective voltage supply lines from the power supplies 51 to 5*n*.

According to the voltage control circuit 5A of the present embodiment, a desired voltage level and voltage waveform are appropriately set to each power supply voltage through the first to nth power supplies 51 to 5*n*, and various voltages can be easily controlled in the gate signal GOUT through selection by the selector switch 41A. The following describes a configuration and operation of the voltage control circuit 5A in an example in which n=4.

FIG. 13 is a circuit diagram illustrating an example of the gate signal generating circuit 4A in the voltage control circuit 5A according to the second embodiment. In the gate signal generating circuit 4A illustrated in FIG. 13, the selector switch 41A includes first, second, third, and fourth transistors P1, P2, P3, and N1 according to n=4. In the present example, the first to third transistors P1 to P3 are PMOS transistors, and the fourth transistor N1 is an NMOS transistor.

As illustrated in FIG. 13, one end of each of the first to fourth transistors P1, P2, P3, and N1 is respectively connected to first to fourth power supplies 51 to 54 through the voltage supply lines such that first to fourth power supply voltages VGH1, VGH2, VGH3, and VGL are applied to the respective transistors. The other end of each of the first to fourth transistors P1 to P3 and N1 is connected in common.

The selector switch control circuit 40 generates first, second, third, and fourth control signals S1, S2, S3, and S4 to respectively turn the first to fourth transistors P1, P2, P3, and N1 on and off. The following describes an example of operation of the voltage control circuit 5A configured as above with reference to FIGS. 14 and 15.

Figures 14A, 14B, 14C, 14D, 14E, 14F, 14G, 14H, 14I:
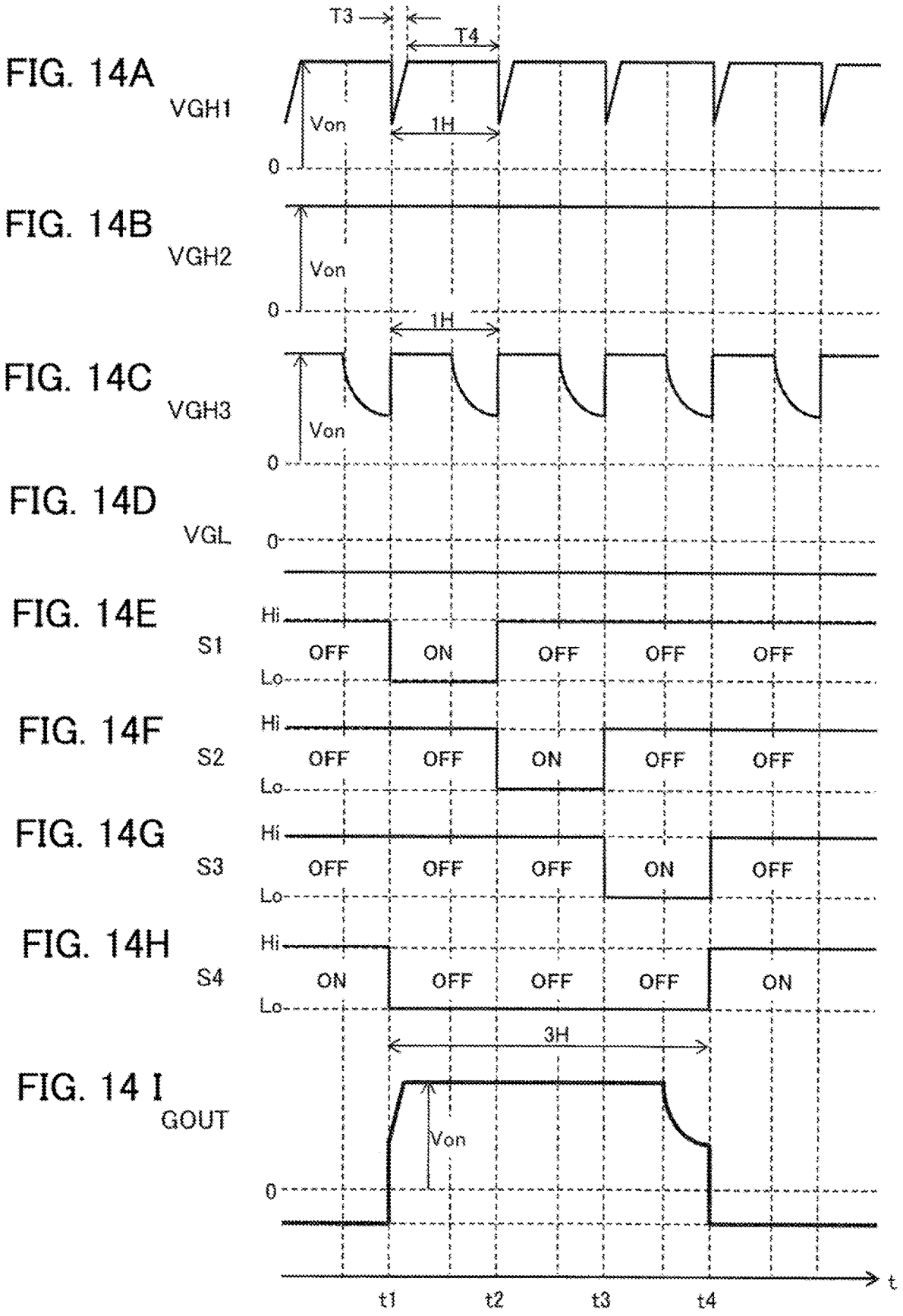
FIG. 14 is a timing diagram illustrating an example of the operation of the voltage control circuit according to the second embodiment.

FIG. 14 is a timing diagram illustrating an example of operation of the voltage control circuit 5A according to the second embodiment. FIGS. 14A to 14D illustrate supply timing of the respective first to fourth power supply voltages VGH1, VGH2, VGH3, and VGL in the example of the present embodiment. FIGS. 14E to 14H illustrate control timing of the respective first to fourth control signals S1, S2, S3, and S4. FIG. 14I illustrates output timing of the gate signal GOUT.

As illustrated in FIG. 14A, the first power supply voltage VGH1 in the example of the present embodiment is set to a voltage with a voltage change interval T3 at the beginning of a single horizontal synchronization period similar to the variation of the first embodiment (FIG. 10A and FIG. 11A). As illustrated in FIGS. 14B to 14D, the second to fourth power supply voltages VGH2, VGH3, and VGL in the present example are set in the same manner as the respective first to third power supply voltages VGH1, VGH2, and VGL (FIGS. 8A to 8C) of the first embodiment.

In FIGS. 14A to 14H, an example of triple pulse operation by the gate signal generating circuit 4A (FIG. 13) of the present example is described. The selector switch control circuit 40 generates the first control signal S1 (FIG. 14E) in the gate signal generating circuit 4A such that the first transistor P1 is on from the time t1 to the time t2 and is off during other periods.

Similarly, the selector switch control circuit 40 generates the second control signal S2 such that the second transistor P2 is on from the time t2 to the time t3 (FIG. 14F) and generates the third control signal S3 such that the third transistor P3 is on from the time t3 to the time t4 (FIG. 14G). The selector switch control circuit 40 also generates the fourth control signal S4 such that the fourth resistor N1 is off during the period of the triple pulse period 3H from the time t1 to the time t4 and is on during other periods (FIG. 14H).

Through the first to fourth control signals S1 to S4 as above, the selector switch 41A sequentially selects the first, second, third, and fourth power supplies 51, 52, 53, and 54 for each single horizontal synchronization period 1H from the time t1. Through the above, the gate signal GOUT is output with a voltage waveform that is slope shaped only at the rise and fall of the waveform without a voltage drop (break) in the middle of the gate pulse in the triple pulse period 3H based on the first, second, and third power supply voltages VGH1, VGH2, and VGH3 (FIG. 14I).

Furthermore, in the voltage control circuit 5A as above, a break in the gate pulse which is slope-shaped at the rise and fall of the gate pulse is avoided by appropriately changing the period in which the selector switch 41A selects the second power supply 52, and various pulse widths can be set while ensuring an adequate charge period.

Figures 15A, 15B, 15C, 15D, 15E, 15F, 15G, 15H, 15I:
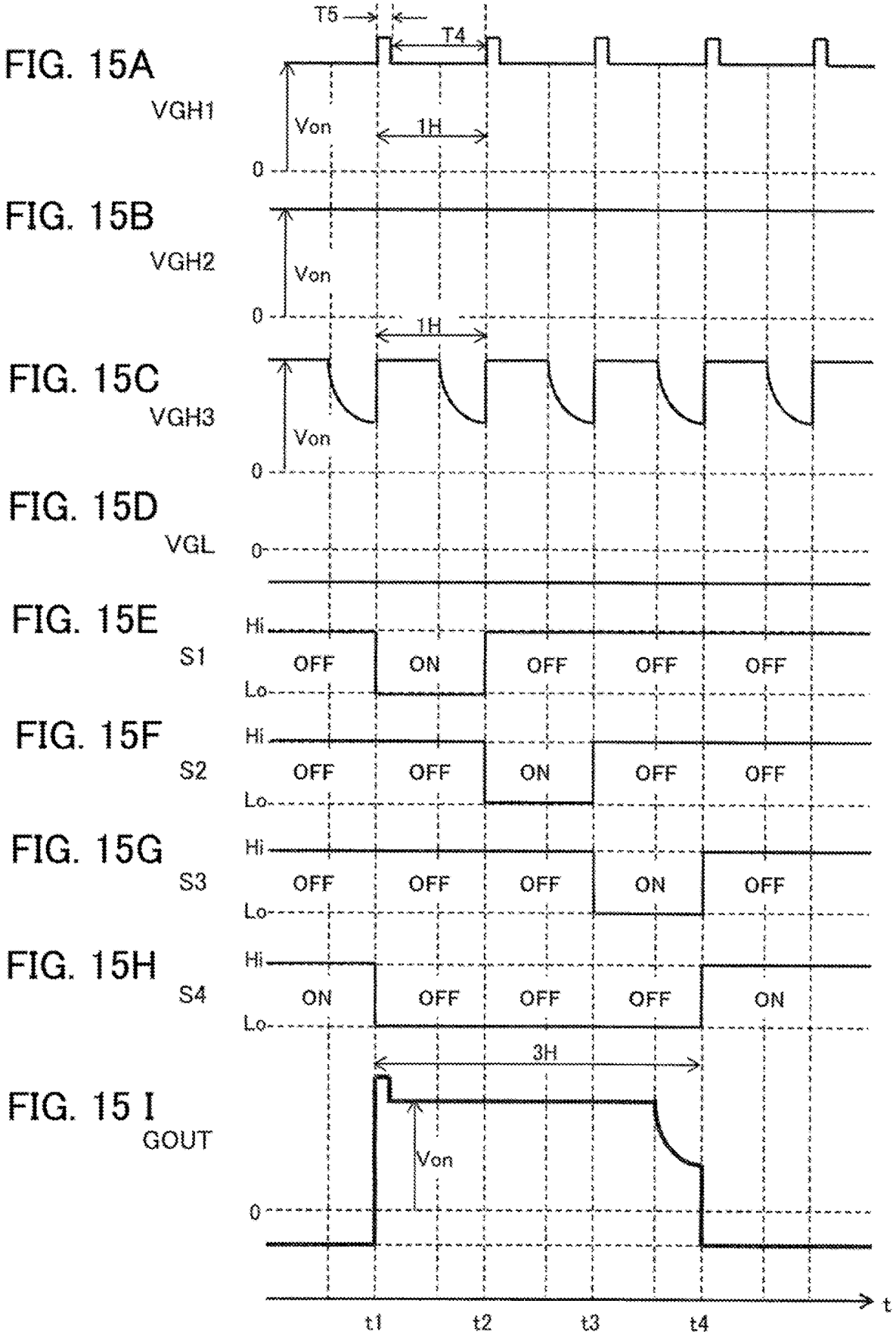
FIG. 15 is a timing diagram illustrating a variation of the operation of the voltage control circuit according to the second embodiment.

FIG. 15 is a timing diagram illustrating a variation of the operation of the voltage control circuit 5A according to the present embodiment. FIGS. 15A to 15D illustrate supply timing of the respective first to fourth power supply voltages VGH1 to VGH3 and VGL in the present variation. FIGS. 15E to 15H illustrate control timing of the respective first to fourth control signals S1 to S4, FIG. 15I illustrates output timing of the gate signal GOUT according to the present variation.

As illustrated in FIG. 15A in the variation illustrated in FIGS. 15A to 15I, a prescribed time interval T5 is set at the beginning of a cycle of a single horizontal synchronization period 1H instead of the voltage change interval T3 (FIG. 14A) in FIGS. 14A to 14I. In the time interval T5, the voltage is a high voltage exceeding the gate-on voltage Von.

In the present variation as illustrated in FIG. 15A, the first power supply voltage VGH1 is set such that a voltage difference from the reference level "0" exceeds the gate-on voltage Von in the time interval T5. In this case, the first power supply 51 (FIG. 4) in the voltage control circuit 5A includes a voltage modulator and a constant voltage source composed of an RC circuit or a charge-pump circuit, for example.

According to the present variation, through the first power supply voltage VGH1 with the time interval T5 as illustrated in FIG. 15I, a voltage difference before and after the rise of the gate signal GOUT can be enlarged more than in the example of operation illustrated in FIGS. 14A to 14I, for example. Through the above, the rise of the gate signal GOUT can be sharpened.

As illustrated above, the first power supply voltage VGH1 in the voltage control circuit 5A (FIG. 15A) may have the time interval T5 at the beginning of a single horizontal synchronization period 1H. Using for example the voltage level (constant voltage) of the fourth power supply voltage VGL (example of the second voltage as a reference, a voltage difference with respect to the voltage level of the fourth power supply voltage VGL is greater in the time interval T5 than in the constant voltage interval T4.

The fourth power supply voltage VGL in the voltage control circuit 5A may also have a constant voltage interval with a voltage level that is the same as in FIG. 15D and a prescribed time interval at the beginning of a cycle of a single horizontal synchronization period 1H that is the same as the above described time interval T5. Using for example the voltage level (constant voltage) of the first power supply voltage VGH1 (example of the first voltage) as a reference, a voltage difference with respect to the voltage level of the first power supply voltage VGH1 is set to be greater in the time interval of the fourth power supply voltage VGL than in the constant voltage interval of the fourth power supply voltage VGL. Through the above, the voltage difference before and after the fall of the gate signal GOUT is enlarged, and the fall of the gate signal GOUT can be sharpened.

Additional Embodiment

In the above first and second embodiments, examples are described in which the switching elements constituting the selector switches 41 and 41A are composed of MOS transistors. The switching elements in the present invention are not limited to MOS transistors, however, and may for example be composed of bipolar transistors.

Also in the above embodiments, an example is described in which the display apparatus 1 constitutes a liquid crystal display such as a liquid crystal television. The display apparatus 1 according to the present invention is not limited as such, however, and may be for example a display module included in various electronic devices.

Also in the above embodiments, an example is described in which COF gate drivers 11 are employed in the display apparatus 1. The display apparatus according to the present invention is not limited to a COF method, however, and may for example employ gate-in-panel (GIP) gate drivers. In this case, the voltage control circuit according to the present invention is appropriately included in the display apparatus together with the GIP gate drivers.

Summary of Aspects

The above describes specific embodiments and variations of the present invention, but the present invention is not limited to the above embodiments and may be implemented in various ways within the scope of the present invention. For example, content of the above individual embodiments may be appropriately combined to form an embodiment of the present invention. The following describes examples of various aspects according to the present invention.

A first aspect of the present invention is directed to a voltage control circuit with three or more power supplies and a selector switch which selects any one of the three or more power supplies to connect to a gate signal line of a liquid crystal panel. In the voltage control circuit, the selector switch controls a voltage to be supplied to the gate signal line by sequentially switching a connection of the gate signal line to any one of the three or more power supplies in a prescribed cycle.

A second aspect of to the present invention is directed to the voltage control circuit according to the first aspect, wherein the prescribed cycle is a single horizontal synchronization period.

A third aspect of to the present invention is directed to the voltage control circuit according to the first or second aspects, wherein at least one of voltages from the three or more power supplies is a first voltage with a constant voltage interval in which a transistor connected to the gate signal line is kept on. At least one of the voltages from the three or more power supplies is a second voltage with a constant voltage interval in which the transistor connected to the gate signal line is kept off.

A fourth aspect of the present invention is directed to the voltage control circuit according to the third aspect, wherein one of the voltages (VGH2) from the three or more power supplies has, at an end of the prescribed cycle, a voltage change interval in which a voltage level approaches a constant voltage of the second voltage from a constant voltage of the first voltage.

A fifth aspect of the present invention is directed to the voltage control circuit according to the third or fourth aspects, wherein the first voltage has, at the beginning of the prescribed cycle, a time interval in which voltage difference with respect to the second voltage is greater than in the constant voltage interval in the first voltage, using the constant voltage of the second voltage as a reference.

A sixth aspect of the present invention is directed to the voltage control circuit according to the third or fourth embodiments, wherein one of the voltages from the three or more power supplies has, at the beginning of the prescribed cycle, a voltage change interval in which a voltage level approaches the constant voltage of the first voltage from the constant voltage of the second voltage.

A seventh aspect of the present invention is directed to the voltage control circuit according to any one of the third to sixth aspects, wherein the second voltage has, at the beginning of the prescribed cycle, a time interval in which a voltage difference with respect to the first voltage is greater than in the constant voltage interval in the second voltage, using the constant voltage of the first voltage as a reference.

An eighth aspect of the present invention is directed to the voltage control circuit according to any one of the first to seventh aspects, wherein the selector switch includes switching elements of the same number as the three or more power supplies. One end of each of the switching elements is connected to a different power supply among the three or more power supplies, and another end of each of the switching elements is connected in common.

A ninth aspect of the present invention is directed to the voltage control circuit according to any one of the first to eighth aspects, further including a selector switch control circuit which controls the selector switch to sequentially switch the connection of the gate signal line to any one of the three or more power supplies in the prescribed cycle.

A tenth aspect of the present invention is directed to a display apparatus including the voltage control circuit according to any one of the first to ninth aspects and a liquid crystal panel including a gate signal line to which voltage controlled by the voltage control circuit is supplied.

The invention claimed is:

1. A voltage control circuit comprising:

three or more power supplies; and a selector switch configured to select any one of the three or more power supplies to connect to a gate signal line of a liquid crystal panel, wherein the selector switch controls a voltage to be supplied to the gate signal line by sequentially switching a connection of the gate signal line to any one of the three or more power supplies in a prescribed cycle, at least one of voltages from the three or more power supplies is a first voltage with a constant voltage interval in which a transistor connected to the gate signal line is kept on, at least one of the voltages from the three or more power supplies is a second voltage with a constant voltage interval in which the transistor connected to the gate signal line is kept off, the selector switch includes switching elements of the same number as the three or more power supplies, and one end of each of the switching elements is connected to a different power supply among the three or more power supplies, and another end of each of the switching elements is connected in common.

2. The voltage control circuit according to claim 1, wherein the prescribed cycle is a single horizontal synchronization period.

3. The voltage control circuit according to claim 1, wherein one of the voltages from the three or more power supplies has, at an end of the prescribed cycle, a voltage change interval in which a voltage level approaches an intermediate voltage between the first and second voltage from a constant voltage of the first voltage.

4. The voltage control circuit according to claim 1, wherein the first voltage has, at a beginning of the prescribed cycle, a time interval in which a voltage difference with respect to the second voltage is greater than that in the constant voltage interval of the first voltage, using the constant voltage of the second voltage as a reference.

5. The voltage control circuit according to claim 1, wherein one of the voltages from the three or more power supplies has, at a beginning of the prescribed cycle, a voltage change interval in which a voltage level approaches the constant voltage of the first voltage from the constant voltage of the second voltage.

6. The voltage control circuit according to claim 1, wherein the second voltage has, at the beginning of the prescribed cycle, a time interval in which a voltage difference with respect to the first voltage is greater than that in the constant voltage interval in the second voltage, using the constant voltage of the first voltage as a reference.

7. The voltage control circuit according to claim 1, further comprising a selector switch control circuit configured to control the selector switch to sequentially switch the connection of the gate signal line to any one of the three or more power supplies in the prescribed cycle.

8. A display apparatus comprising:

the voltage control circuit according to claim 1; and a liquid crystal panel including a gate signal line to which a voltage controlled by the voltage control circuit is supplied.

9. The voltage control circuit according to claim 1, wherein one of the voltages from the three or more power supplies has a voltage change interval in the prescribed cycle.

10. The voltage control circuit according to claim 1, wherein the selector switch outputs a gate signal to the gate signal line by sequentially switching the connection of the gate signal line to any one of the three or more power supplies in the prescribed cycle, and a pulse width of a gate pulse in the gate signal is a period of a single horizontal period multiplied by an integer of two or more.

* * * * *